US010287889B2

(12) United States Patent
Moradi

(10) Patent No.: US 10,287,889 B2
(45) Date of Patent: May 14, 2019

(54) POWER TURBINE VANE AIRFOIL PROFILE

(71) Applicant: PRATT & WHITNEY CANADA CORP., Longueuil (CA)

(72) Inventor: Niloofar Moradi, Longueuil (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 38 days.

(21) Appl. No.: 15/715,441

(22) Filed: Sep. 26, 2017

(65) Prior Publication Data

US 2019/0093482 A1 Mar. 28, 2019

(51) Int. Cl.
*F01D 5/14* (2006.01)

(52) U.S. Cl.
CPC ..... *F01D 5/141* (2013.01); *F05D 2240/301* (2013.01); *F05D 2250/74* (2013.01)

(58) Field of Classification Search
CPC ..... F01D 5/14; F01D 5/141; F05D 2240/301; F05D 2250/74
See application file for complete search history.

(56) References Cited

U.S. PATENT DOCUMENTS 6,398,489 B1 6/2002 Burdgick et al.
6,832,897 B2 12/2004 Urban
6,854,961 B2 2/2005 Zhang et al.
6,910,868 B2 6/2005 Hyde et al.
7,306,436 B2 12/2007 Girgis et al.
7,351,038 B2 4/2008 Girgis et al.
7,354,249 B2 4/2008 Girgis et al.
7,367,779 B2 5/2008 Girgis et al.
7,402,026 B2 7/2008 Girgis et al.
7,520,726 B2 4/2009 Papple et al.
7,520,727 B2 4/2009 Sreekanth et al.
7,520,728 B2 4/2009 Sleiman et al.
7,534,091 B2 5/2009 Ravanis et al.
7,537,432 B2 5/2009 Marini et al.
7,537,433 B2 5/2009 Girgis et al.
7,559,746 B2 7/2009 Tsifourdaris et al.
7,559,747 B2 7/2009 Mohan et al.
7,559,748 B2 7/2009 Kidikian et al.
7,559,749 B2 7/2009 Kidikian et al.
7,566,200 B2 7/2009 Marini et al.
7,568,889 B2 8/2009 Mohan et al.
7,568,890 B2 8/2009 Findlay et al.
7,568,891 B2 8/2009 Mohan et al.
7,611,326 B2 11/2009 Trindade et al.
7,625,182 B2 12/2009 Mah et al.
7,625,183 B2 12/2009 Tsifourdaris et al.
7,632,074 B2 12/2009 Ravanis et al.
8,100,659 B2 1/2012 Marini
8,105,043 B2 1/2012 Tsifourdaris
8,105,044 B2 1/2012 Marini et al.
(Continued)

*Primary Examiner* — Hieu T Vo
(74) *Attorney, Agent, or Firm* — Norton Rose Fulbright Canada LLP

(57) ABSTRACT

A power turbine includes a first stage vane having an airfoil with a cold nominal profile substantially in accordance with at least an intermediate portion of the Cartesian coordinate values of X, Y and Z set forth in Table 2. The X and Y values are distances, which when smoothly connected by an appropriate continuing curve, define airfoil profile sections at each distance Z. The profile sections at each distance Z are joined smoothly to one another to form a complete airfoil shape.

10 Claims, 5 Drawing Sheets

(56) References Cited

U.S. PATENT DOCUMENTS

| | | | | |
|---|---|---|---|---|
| 8,167,568 | B2 * | 5/2012 | Tsifourdaris | F01D 5/141 415/191 |
| 8,439,645 | B2 * | 5/2013 | Tsifourdaris | F01D 5/141 416/223 R |
| 2005/0079061 | A1 | 4/2005 | Beddard | |
| 2008/0124219 | A1 | 5/2008 | Kidikian et al. | |
| 2009/0097982 | A1 | 4/2009 | Saindon et al. | |
| 2009/0116967 | A1 | 5/2009 | Sleiman et al. | |
| 2010/0008784 | A1 | 1/2010 | Shafique et al. | |
| 2011/0229317 | A1 | 9/2011 | Marini | |
| 2011/0236214 | A1 | 9/2011 | Tsifourdaris | |
| 2011/0243747 | A1 | 10/2011 | Marini | |
| 2011/0243748 | A1 | 10/2011 | Tsifourdaris | |

* cited by examiner

POWER TURBINE VANE AIRFOIL PROFILE

TECHNICAL FIELD

The application relates generally to a vane airfoil and, more particularly, to an airfoil profile suited for use in a power turbine stage of a gas turbine engine.

BACKGROUND OF THE ART

Every stage of a gas turbine engine must meet a plurality of design criteria to assure the best possible overall engine efficiency. The design goals dictate specific thermal and mechanical requirements that must be met pertaining to heat loading, parts life and manufacturing, use of combustion gases, throat area, vectoring, the interaction between stages to name a few. The design criteria for each stage is constantly being re-evaluated and improved upon. Each airfoil is subject to flow regimes which lend themselves easily to flow separation, which tend to limit the amount of work transferred to the compressor, and hence the total thrust or power capability of the engine. The vanes of a power turbine are also subject to harsh temperatures and pressures, which require a solid balance between aerodynamic and structural optimization. Therefore, improvements in airfoil design are sought.

SUMMARY

In one aspect, the present application provides a turbine vane for a gas turbine engine having a gaspath, the vane comprising an airfoil having an intermediate portion contained within the gaspath and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In another aspect, the present application provides a turbine vane for a gas turbine engine having a gaspath, the turbine vane having a cold uncoated intermediate airfoil portion contained within the gaspath and defined by a nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In another aspect, the present application provides a turbine stator assembly for a gas turbine engine having a gaspath, the assembly comprising a plurality of vanes, each vane including an airfoil having an intermediate portion contained with the gaspath of the engine and defined by an un-coated nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

In a still further aspect of the present application, there is provided a first stage power turbine vane comprising: at least one airfoil having a surface lying substantially on the points of Table 2, the airfoil extending between platforms defined generally by at least some of the coordinate values given in Table 1, wherein a fillet radius is applied around the airfoil between the airfoil and platforms.

Further details of these and other aspects of the present application will be apparent from the detailed description and figures included below.

DESCRIPTION OF THE DRAWINGS

Reference is now made to the accompanying figures depicting aspects of the present invention, in which.

DETAILED DESCRIPTION

Figure 1:
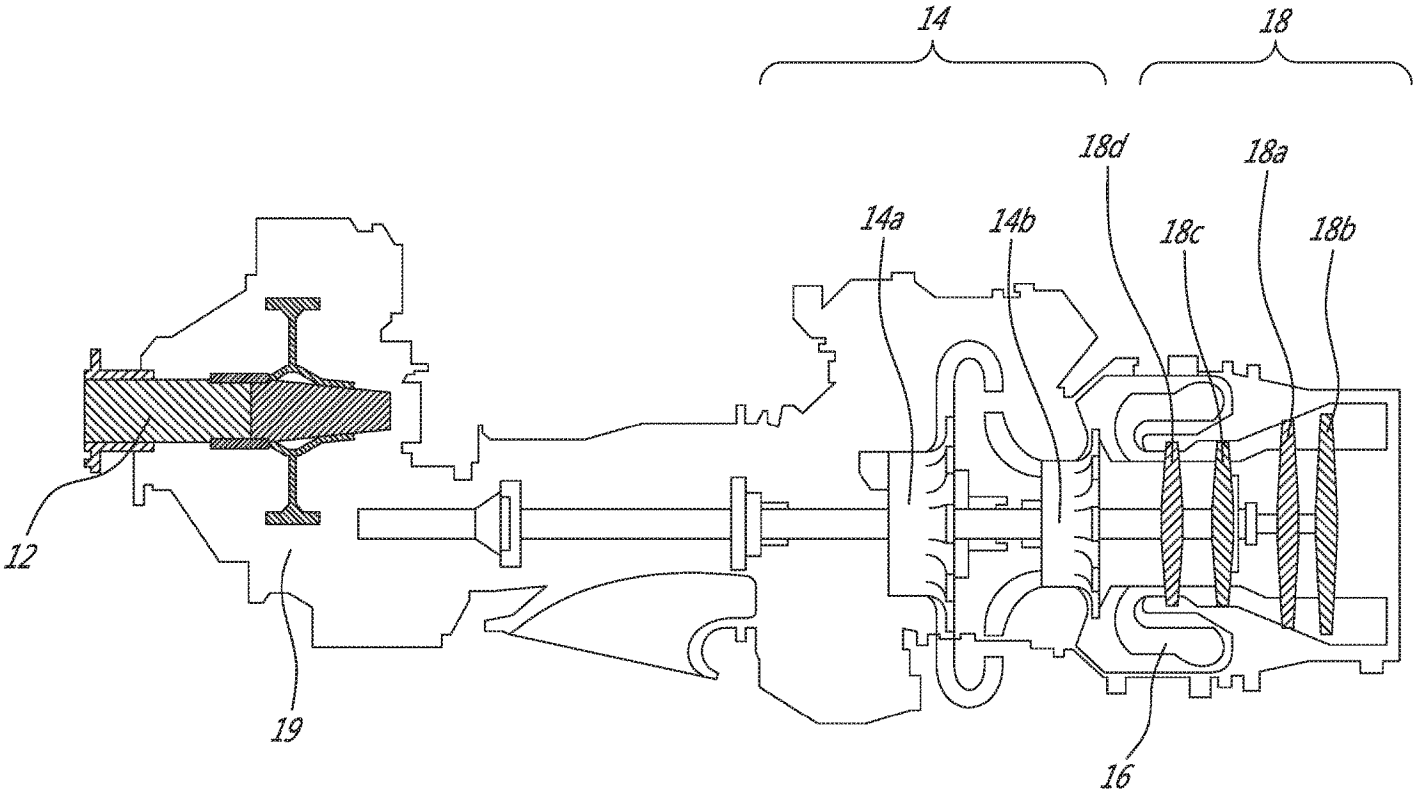
FIG. 1 is a schematic view of a turboprop gas turbine engine.

FIG. 1 illustrates a turboprop gas turbine engine 10 of a type preferably provided for use in subsonic flight, generally comprising in serial flow communication a multi-stage compressor section 14 for pressurizing the air, a combustor 16 in which the compressed air is mixed with fuel and ignited for generating an annular stream of hot combustion gases, and a turbine section 18 for extracting energy from the combustion gases. According to the illustrated example, the turbine section 18 comprises a two-stage power turbine 18*a*, 18*b* and single-stage low pressure (LP) and high pressure (HP) compressor turbines 18*c*, 18*d*. The LP and HP compressor turbines 18*c*, 18*d* respectively and idenpendently drive an LP compressor 14*a* and an HP compressor 14*b*. The power turbine 18*a* drives a propeller shaft 12 via a reduction gearbox 19.

Figure 2:
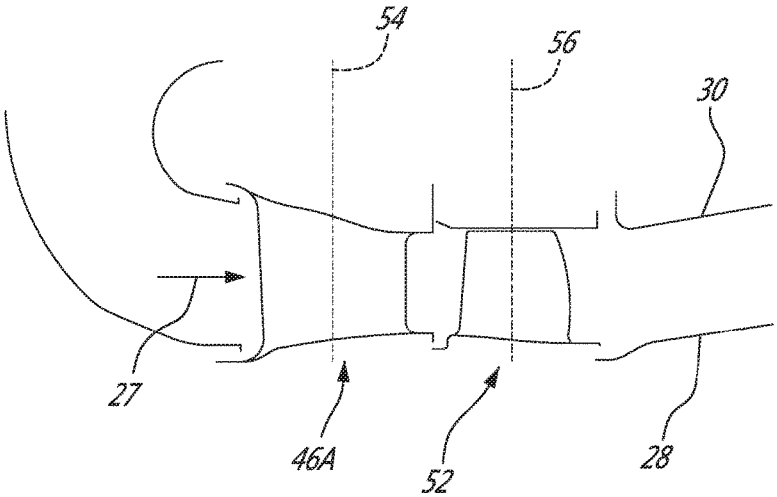
FIG. 2 is a schematic view of a gas path of a first stage power turbine section of the engine shown in FIG. 1.
Figure 2:
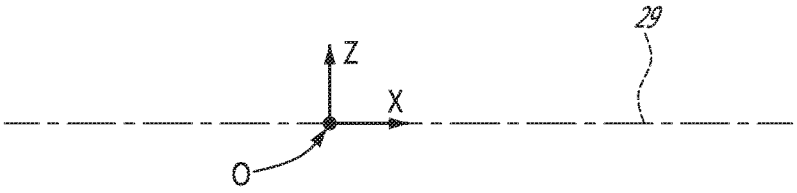

FIG. 2 illustrates an upstream portion of an annular hot gaspath of the two-stage power turbine. Arrows 27 illustrate the flow of hot combustion gases through the power turbine 18*a*, 18*b*. The gaspath is defined by annular inner and outer walls 28 and 30 respectively, for directing the stream of hot combustion gases axially in an annular flow through the power turbine 18*a*, 18*b*. The profile of the inner and outer walls 28 and 30 of the cold annular gaspath is defined by Cartesian coordinate values such as the ones given in Table 1 below. More particularly, the inner and outer gaspath walls 28 and 30 are defined with respect to mutually orthogonal x and z axes, as shown in FIG. 2. The x axis corresponds to the engine turbine rotor centerline 29. The radial distance of the inner and outer walls 28 and 30 from the engine turbine rotor centerline and, thus, from the x-axis at specific axial locations is measured along the z axis. The z values provide the inner and outer radius of the gas path at various axial locations therealong. The x and z coordinate values in Table 1 are distances given in inches from the point of origin O (see FIG. 2). It is understood that other units of dimensions may be used. The x and z values have in average a manufacturing tolerance of about ±0.030". The tolerance may account for such things as casting, coating and/or other tolerances. It is understood that the manufacturing tolerances of the gas path may vary along the length thereof.

Figure 3:
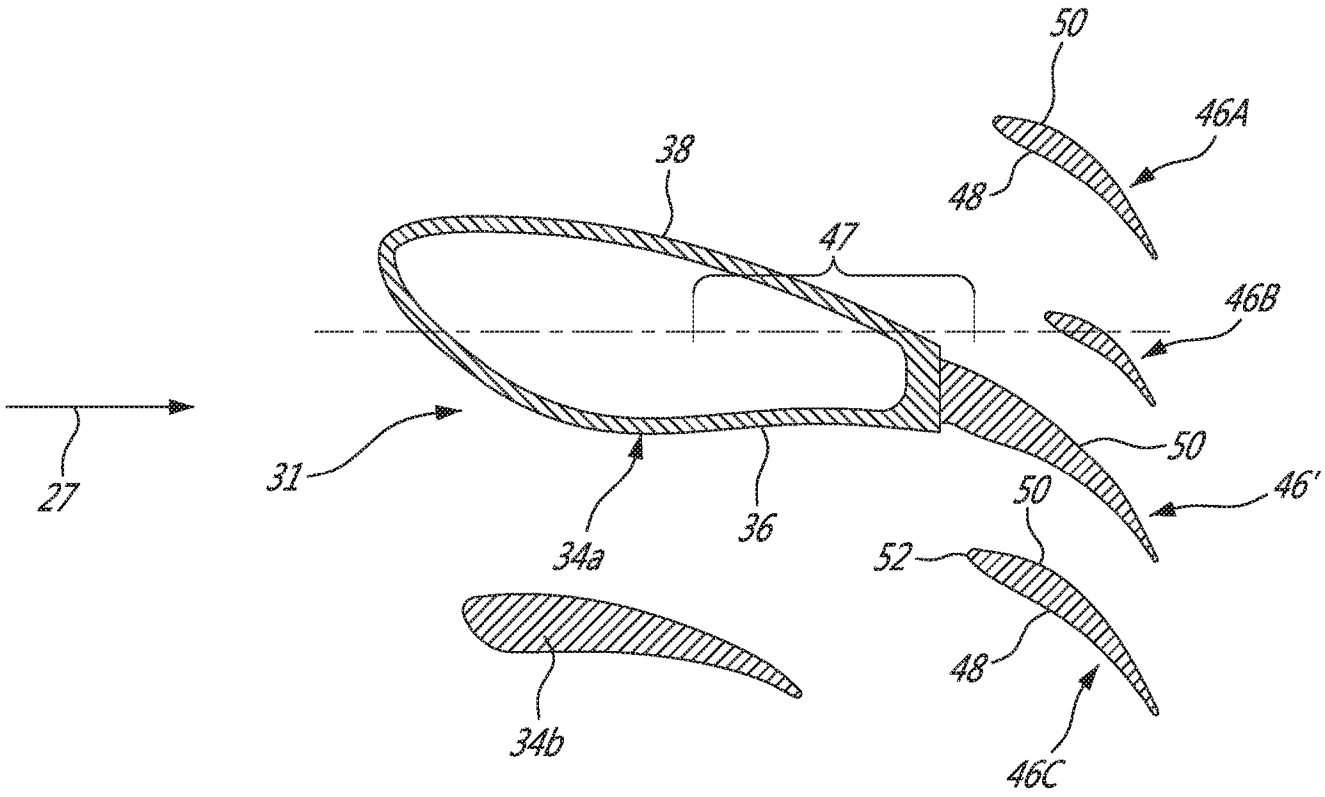
FIG. 3 is a schematic cross-section view illustrating the axial and circumferential disposition of an integrated strut vane (ISV) relative to the first stage power turbine (PT1) vanes, and the thin struts upstream of the first stage power turbine rotor.

As shown in FIG. 3, the upstream portion of the gaspath 27 of the power turbine section may comprise a number of circumferentially spaced-apart struts 34*a*, 34*b* disposed upstream of a circumferential array of PT1 vanes 46A, 46B, 46C . . . . As denoted by reference numeral 47 some of the struts 34*a* may be integrated with a corresponding PT1 vane 46' to form an integrated strut-vane (ISV). The integration is made by combining the airfoil shape of the strut 34 with the airfoil shape of the associated vane 46'. As can be appreciated from FIG. 3, the pressure and suction sidewalls 48 and 50 of vane 46' extend rearwardly generally in continuity to the corresponding pressure and suction sidewalls 36 and 38 of the associated strut 34 to form the ISV 47. The remaining struts 34*b* are herein referred to as "thin struts". As can be appreciated from FIG. 3, the leading edge of the thin struts 34*b* is disposed downstream of the leading edge of the ISV 47 while the trailing edge of the thin struts 34*b* is upstream of the leading edge of the PT1 vanes 46*a*. According to one embodiment, the gas path comprises 51 PT1 vanes, 3 ISV and 3 thin struts.

In order to minimize losses and avoid separation zones, the ISV neighbouring vanes 46B, 46C on opposed sides of the ISV 47 (that is the PT1 vanes immediately adjacent to the pressure and suctions sides of the ISV) can have tailored airfoil shapes different from the airfoil profile of the other PT1 vanes 46A. Vane 46B is herein referred to as the integrated strut vane suction side (ISVSS) adjacent vane. Vane 46C is herein referred to as the integrated strut vane pressure side (ISVPS) adjacent vane. As can be appreciated from FIG. 3, the ISVSS and ISVPS adjacent vanes have different airfoil profiles.

Referring back to FIG. 2, it can be appreciated that the PT1 vanes 46A are disposed upstream of a first stage of power turbine blades 52. The PT1 vanes 46A and the blades 52 are mounted in position along respective stacking lines 54, 56, as identified in FIG. 2. The stacking lines 54, 56 extend in the radial direction along the z axis at different axial locations. The stacking lines 54, 56 define the axial location where the vanes and blades of each stage are mounted in the engine 10. More specifically, stacking line 54 located at x=0 corresponds to the first stage of vanes 46A of the power turbine.

TABLE 1

| Cold Gaspath definition | | | | | | | |
|---|---|---|---|---|---|---|---|
| ID Gaspath | | | | OD Gaspath | | | |
| | X | Z | | | X | Z | |
| * | 0.540 | 4.790 | * | * | 0.520 | 6.735 | * |
| | 0.448 | 4.790 | | | 0.436 | 6.699 | |
| | 0.356 | 4.790 | | | 0.352 | 6.663 | |
| | 0.264 | 4.790 | | | 0.268 | 6.627 | |
| | 0.172 | 4.789 | | | 0.184 | 6.591 | |
| | 0.081 | 4.783 | | | 0.100 | 6.555 | |
| | −0.011 | 4.774 | | | 0.016 | 6.519 | |
| | −0.102 | 4.764 | | | −0.069 | 6.483 | |
| | −0.193 | 4.751 | | | −0.153 | 6.448 | |
| | −0.283 | 4.733 | | | −0.238 | 6.413 | |
| | −0.372 | 4.709 | | | −0.322 | 6.378 | |
| | −0.457 | 4.674 | | | −0.407 | 6.343 | |
| | −0.529 | 4.619 | | | −0.491 | 6.308 | |

TABLE 1-continued

| Cold Gaspath definition | | | | | | | |
|---|---|---|---|---|---|---|---|
| ID Gaspath | | | | OD Gaspath | | | |
| | X | Z | | | X | Z | |
| | −0.595 | 4.554 | | | −0.576 | 6.273 | |
| * | −0.660 | 4.489 | * | * | −0.660 | 6.238 | * |

Figure 4:
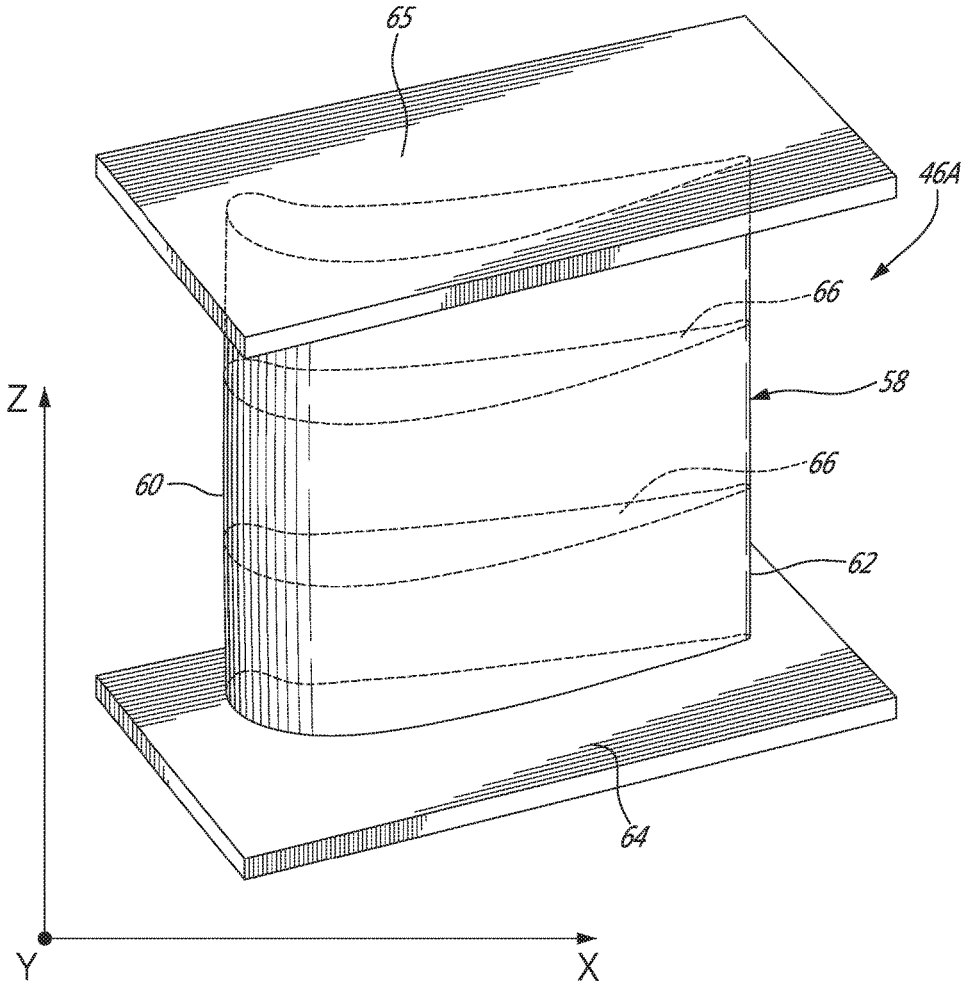
FIG. 4 is a schematic perspective view of a first stage power turbine vane having a vane profile defined in accordance with an embodiment of the present application.

FIG. 4 shows an example of a vane 46A of the first stage of the power turbine. It can be seen that each PT1 vane 46A has an airfoil 58 having a leading edge 60 and a trailing edge 62, extending between an inner platform 64 and an outer platform 65.

The novel airfoil shape of the PT1 vane 46A is defined by a set of X-Y-Z points in space. This set of points represents a novel and unique solution to the target design criteria discussed above, and are well-adapted for use in a two-stage power turbine design. The set of points are defined in a Cartesian coordinate system which has mutually orthogonal X, Y and Z axes. The X axis extends axially along the turbine rotor centerline 29, i.e., the rotary axis. The positive X direction is axially towards the aft of the turbine engine 10. The Z axis extends along the vane stacking line 54 of each respective vane 46A in a generally radial direction and intersects the X axis. The positive Z direction is radially outwardly toward the outer shroud 65 of the vane. The Y axis extends tangentially with the positive Y direction being in the direction of rotation of the rotor assembly 52. Therefore, the origin of the X, Y and Z axes is defined at the point of intersection of all three orthogonally-related axes: that is the point (0,0,0) at the intersection of the center of rotation of the turbine engine 10 and the stacking line 54.

In a particular embodiment of the first stage power turbine vane, the set of points which define the vane airfoil profile relative to the axis of rotation of the turbine engine 10 and stacking line 54 thereof are set out in Table 2 below as X, Y and Z Cartesian coordinate values. Particularly, the vane airfoil profile is defined by profile sections 66 at various locations along its height, the locations represented by Z values. For example, if the vanes 46A are mounted at an angle with respect to the radial direction, then the Z values are not a true representation of the height of the airfoils of the vanes 46A. Furthermore, it is to be appreciated that, with respect to Table 2, Z values are not actually radial heights, per se, from the centerline but rather a height from a plane through the centerline—i.e. the sections in Table 2 are planar. The coordinate values are set forth in inches in Table 2 although other units of dimensions may be used when the values are appropriately converted.

Thus, at each Z distance, the X and Y coordinate values of the desired profile section 66 are defined at selected locations in a Z direction normal to the X, Y plane. The X and Y coordinates are given in distance dimensions, e.g., units of inches, and are joined smoothly, using appropriate curve-fitting techniques, at each Z location to form a smooth continuous airfoil cross-section. The vane airfoil profiles of the various surface locations between the distances Z are determined by smoothly connecting the adjacent profile sections 66 to one another to form the airfoil profile.

The coordinate values listed in Table 2 below represent the desired airfoil profiles in a "cold" non-operating uncoated condition (and at nominal restagger). However, the manufactured airfoil surface profile will be slightly different, as a result of manufacturing tolerances.

The Table 2 values are generated and shown to three decimal places for determining the profile of the first stage power turbine vane airfoil. However, as mentioned above, there are manufacturing tolerance issues to be addressed and, accordingly, the values for the profile given in Table 2 are for a theoretical airfoil. A profile tolerance of ±0.009 inches, measured perpendicularly to the airfoil surface is additive to the nominal values given in Table 2 below. The vane airfoil design functions well within these ranges of variation. The cold or room temperature profile is given by the X, Y and Z coordinates for manufacturing purposes. It is understood that the airfoil may deform, within acceptable limits, once entering service.

The coordinate values given in Table 2 below provide the preferred nominal first stage power turbine vane airfoil profile.

TABLE 2

| X | Y | Z |
|---|---|---|
| SECTION 1 | | |
| −0.2607 | −0.1683 | 4.5600 |
| −0.2590 | −0.1680 | 4.5600 |
| −0.2573 | −0.1679 | 4.5600 |
| −0.2556 | −0.1677 | 4.5600 |
| −0.2539 | −0.1676 | 4.5600 |
| −0.2522 | −0.1675 | 4.5600 |
| −0.2505 | −0.1674 | 4.5600 |
| −0.2488 | −0.1672 | 4.5600 |
| −0.2472 | −0.1670 | 4.5600 |
| −0.2455 | −0.1668 | 4.5600 |
| −0.2438 | −0.1665 | 4.5600 |
| −0.2354 | −0.1653 | 4.5600 |
| −0.2271 | −0.1638 | 4.5600 |
| −0.2188 | −0.1621 | 4.5600 |
| −0.2105 | −0.1601 | 4.5600 |
| −0.2023 | −0.1579 | 4.5600 |
| −0.1942 | −0.1556 | 4.5600 |
| −0.1861 | −0.1531 | 4.5600 |
| −0.1780 | −0.1506 | 4.5600 |
| −0.1699 | −0.1480 | 4.5600 |
| −0.1618 | −0.1454 | 4.5600 |
| −0.1538 | −0.1426 | 4.5600 |
| −0.1458 | −0.1398 | 4.5600 |
| −0.1378 | −0.1369 | 4.5600 |
| −0.1299 | −0.1340 | 4.5600 |
| −0.1220 | −0.1309 | 4.5600 |
| −0.1141 | −0.1276 | 4.5600 |
| −0.1063 | −0.1243 | 4.5600 |
| −0.0986 | −0.1209 | 4.5600 |
| −0.0909 | −0.1173 | 4.5600 |
| −0.0832 | −0.1136 | 4.5600 |
| −0.0757 | −0.1098 | 4.5600 |
| −0.0681 | −0.1060 | 4.5600 |
| −0.0606 | −0.1020 | 4.5600 |
| −0.0532 | −0.0979 | 4.5600 |
| −0.0458 | −0.0938 | 4.5600 |
| −0.0384 | −0.0896 | 4.5600 |
| −0.0310 | −0.0854 | 4.5600 |
| −0.0237 | −0.0811 | 4.5600 |
| −0.0164 | −0.0767 | 4.5600 |
| −0.0092 | −0.0724 | 4.5600 |
| −0.0019 | −0.0680 | 4.5600 |
| 0.0053 | −0.0636 | 4.5600 |
| 0.0125 | −0.0591 | 4.5600 |
| 0.0198 | −0.0547 | 4.5600 |
| 0.0269 | −0.0501 | 4.5600 |
| 0.0341 | −0.0456 | 4.5600 |
| 0.0413 | −0.0411 | 4.5600 |
| 0.0484 | −0.0365 | 4.5600 |
| 0.0555 | −0.0319 | 4.5600 |
| 0.0626 | −0.0272 | 4.5600 |
| 0.0697 | −0.0225 | 4.5600 |
| 0.0767 | −0.0178 | 4.5600 |
| 0.0837 | −0.0130 | 4.5600 |
| 0.0907 | −0.0082 | 4.5600 |

TABLE 2-continued

| X | Y | Z |
|---|---|---|
| 0.0977 | −0.0033 | 4.5600 |
| 0.1046 | 0.0016 | 4.5600 |
| 0.1114 | 0.0066 | 4.5600 |
| 0.1183 | 0.0116 | 4.5600 |
| 0.1250 | 0.0167 | 4.5600 |
| 0.1318 | 0.0218 | 4.5600 |
| 0.1385 | 0.0270 | 4.5600 |
| 0.1451 | 0.0323 | 4.5600 |
| 0.1517 | 0.0376 | 4.5600 |
| 0.1582 | 0.0431 | 4.5600 |
| 0.1647 | 0.0485 | 4.5600 |
| 0.1712 | 0.0540 | 4.5600 |
| 0.1775 | 0.0596 | 4.5600 |
| 0.1839 | 0.0653 | 4.5600 |
| 0.1901 | 0.0710 | 4.5600 |
| 0.1963 | 0.0768 | 4.5600 |
| 0.2025 | 0.0826 | 4.5600 |
| 0.2086 | 0.0885 | 4.5600 |
| 0.2146 | 0.0945 | 4.5600 |
| 0.2206 | 0.1005 | 4.5600 |
| 0.2266 | 0.1065 | 4.5600 |
| 0.2324 | 0.1126 | 4.5600 |
| 0.2383 | 0.1188 | 4.5600 |
| 0.2440 | 0.1250 | 4.5600 |
| 0.2497 | 0.1313 | 4.5600 |
| 0.2554 | 0.1376 | 4.5600 |
| 0.2610 | 0.1440 | 4.5600 |
| 0.2665 | 0.1504 | 4.5600 |
| 0.2721 | 0.1569 | 4.5600 |
| 0.2775 | 0.1633 | 4.5600 |
| 0.2829 | 0.1699 | 4.5600 |
| 0.2884 | 0.1764 | 4.5600 |
| 0.2937 | 0.1829 | 4.5600 |
| 0.2991 | 0.1895 | 4.5600 |
| 0.3045 | 0.1960 | 4.5600 |
| 0.3056 | 0.1973 | 4.5600 |
| 0.3067 | 0.1986 | 4.5600 |
| 0.3078 | 0.2000 | 4.5600 |
| 0.3088 | 0.2013 | 4.5600 |
| 0.3099 | 0.2026 | 4.5600 |
| 0.3110 | 0.2039 | 4.5600 |
| 0.3121 | 0.2052 | 4.5600 |
| 0.3132 | 0.2065 | 4.5600 |
| 0.3142 | 0.2078 | 4.5600 |
| 0.3153 | 0.2091 | 4.5600 |
| 0.3163 | 0.2106 | 4.5600 |
| 0.3170 | 0.2122 | 4.5600 |
| 0.3175 | 0.2140 | 4.5600 |
| 0.3177 | 0.2158 | 4.5600 |
| 0.3176 | 0.2175 | 4.5600 |
| 0.3172 | 0.2193 | 4.5600 |
| 0.3165 | 0.2209 | 4.5600 |
| 0.3156 | 0.2225 | 4.5600 |
| 0.3144 | 0.2239 | 4.5600 |
| 0.3131 | 0.2250 | 4.5600 |
| 0.3115 | 0.2259 | 4.5600 |
| 0.3098 | 0.2266 | 4.5600 |
| 0.3081 | 0.2269 | 4.5600 |
| 0.3063 | 0.2270 | 4.5600 |
| 0.3045 | 0.2268 | 4.5600 |
| 0.3028 | 0.2264 | 4.5600 |
| 0.3012 | 0.2256 | 4.5600 |
| 0.2997 | 0.2246 | 4.5600 |
| 0.2984 | 0.2234 | 4.5600 |
| 0.2973 | 0.2222 | 4.5600 |
| 0.2962 | 0.2210 | 4.5600 |
| 0.2951 | 0.2199 | 4.5600 |
| 0.2939 | 0.2187 | 4.5600 |
| 0.2928 | 0.2175 | 4.5600 |
| 0.2916 | 0.2163 | 4.5600 |
| 0.2905 | 0.2152 | 4.5600 |
| 0.2893 | 0.2140 | 4.5600 |
| 0.2882 | 0.2129 | 4.5600 |
| 0.2870 | 0.2118 | 4.5600 |
| 0.2812 | 0.2061 | 4.5600 |
| 0.2752 | 0.2006 | 4.5600 |
| 0.2691 | 0.1952 | 4.5600 |
| 0.2630 | 0.1899 | 4.5600 |

TABLE 2-continued

| X | Y | Z |
|---|---|---|
| 0.2567 | 0.1847 | 4.5600 |
| 0.2504 | 0.1796 | 4.5600 |
| 0.2440 | 0.1746 | 4.5600 |
| 0.2375 | 0.1697 | 4.5600 |
| 0.2310 | 0.1649 | 4.5600 |
| 0.2244 | 0.1601 | 4.5600 |
| 0.2177 | 0.1554 | 4.5600 |
| 0.2111 | 0.1508 | 4.5600 |
| 0.2043 | 0.1462 | 4.5600 |
| 0.1976 | 0.1417 | 4.5600 |
| 0.1908 | 0.1372 | 4.5600 |
| 0.1840 | 0.1327 | 4.5600 |
| 0.1772 | 0.1283 | 4.5600 |
| 0.1703 | 0.1239 | 4.5600 |
| 0.1635 | 0.1196 | 4.5600 |
| 0.1566 | 0.1152 | 4.5600 |
| 0.1498 | 0.1109 | 4.5600 |
| 0.1429 | 0.1065 | 4.5600 |
| 0.1360 | 0.1022 | 4.5600 |
| 0.1291 | 0.0979 | 4.5600 |
| 0.1222 | 0.0936 | 4.5600 |
| 0.1153 | 0.0893 | 4.5600 |
| 0.1084 | 0.0850 | 4.5600 |
| 0.1015 | 0.0807 | 4.5600 |
| 0.0945 | 0.0765 | 4.5600 |
| 0.0876 | 0.0722 | 4.5600 |
| 0.0807 | 0.0680 | 4.5600 |
| 0.0737 | 0.0637 | 4.5600 |
| 0.0668 | 0.0595 | 4.5600 |
| 0.0598 | 0.0553 | 4.5600 |
| 0.0529 | 0.0511 | 4.5600 |
| 0.0459 | 0.0470 | 4.5600 |
| 0.0389 | 0.0428 | 4.5600 |
| 0.0319 | 0.0387 | 4.5600 |
| 0.0249 | 0.0346 | 4.5600 |
| 0.0179 | 0.0305 | 4.5600 |
| 0.0108 | 0.0264 | 4.5600 |
| 0.0046 | 0.0228 | 4.5600 |
| −0.0033 | 0.0183 | 4.5600 |
| −0.0103 | 0.0143 | 4.5600 |
| −0.0174 | 0.0103 | 4.5600 |
| −0.0245 | 0.0063 | 4.5600 |
| −0.0316 | 0.0023 | 4.5600 |
| −0.0387 | −0.0017 | 4.5600 |
| −0.0458 | −0.0056 | 4.5600 |
| −0.0529 | −0.0096 | 4.5600 |
| −0.0600 | −0.0135 | 4.5600 |
| −0.0671 | −0.0174 | 4.5600 |
| −0.0743 | −0.0213 | 4.5600 |
| −0.0814 | −0.0251 | 4.5600 |
| −0.0886 | −0.0290 | 4.5600 |
| −0.0958 | −0.0328 | 4.5600 |
| −0.1030 | −0.0365 | 4.5600 |
| −0.1102 | −0.0402 | 4.5600 |
| −0.1175 | −0.0439 | 4.5600 |
| −0.1248 | −0.0475 | 4.5600 |
| −0.1321 | −0.0511 | 4.5600 |
| −0.1394 | −0.0546 | 4.5600 |
| −0.1459 | −0.0577 | 4.5600 |
| −0.1541 | −0.0615 | 4.5600 |
| −0.1615 | −0.0649 | 4.5600 |
| −0.1689 | −0.0683 | 4.5600 |
| −0.1763 | −0.0716 | 4.5600 |
| −0.1837 | −0.0750 | 4.5600 |
| −0.1910 | −0.0785 | 4.5600 |
| −0.1984 | −0.0820 | 4.5600 |
| −0.2057 | −0.0855 | 4.5600 |
| −0.2130 | −0.0891 | 4.5600 |
| −0.2202 | −0.0928 | 4.5600 |
| −0.2274 | −0.0966 | 4.5600 |
| −0.2346 | −0.1004 | 4.5600 |
| −0.2418 | −0.1042 | 4.5600 |
| −0.2490 | −0.1080 | 4.5600 |
| −0.2562 | −0.1117 | 4.5600 |
| −0.2634 | −0.1156 | 4.5600 |
| −0.2648 | −0.1164 | 4.5600 |
| −0.2662 | −0.1172 | 4.5600 |
| −0.2676 | −0.1180 | 4.5600 |

TABLE 2-continued

| X | Y | Z |
|---|---|---|
| −0.2690 | −0.1187 | 4.5600 |
| −0.2705 | −0.1195 | 4.5600 |
| −0.2719 | −0.1202 | 4.5600 |
| −0.2734 | −0.1210 | 4.5600 |
| −0.2748 | −0.1218 | 4.5600 |
| −0.2762 | −0.1226 | 4.5600 |
| −0.2776 | −0.1235 | 4.5600 |
| −0.2807 | −0.1259 | 4.5600 |
| −0.2837 | −0.1285 | 4.5600 |
| −0.2864 | −0.1314 | 4.5600 |
| −0.2888 | −0.1346 | 4.5600 |
| −0.2909 | −0.1380 | 4.5600 |
| −0.2925 | −0.1416 | 4.5600 |
| −0.2936 | −0.1454 | 4.5600 |
| −0.2940 | −0.1493 | 4.5600 |
| −0.2937 | −0.1533 | 4.5600 |
| −0.2923 | −0.1570 | 4.5600 |
| −0.2901 | −0.1603 | 4.5600 |
| −0.2872 | −0.1630 | 4.5600 |
| −0.2839 | −0.1652 | 4.5600 |
| −0.2803 | −0.1668 | 4.5600 |
| −0.2765 | −0.1679 | 4.5600 |
| −0.2725 | −0.1686 | 4.5600 |
| −0.2686 | −0.1688 | 4.5600 |
| −0.2646 | −0.1687 | 4.5600 |
| SECTION 2 | | |
| −0.2806 | −0.2422 | 4.8800 |
| −0.2787 | −0.2417 | 4.8800 |
| −0.2769 | −0.2412 | 4.8800 |
| −0.2750 | −0.2407 | 4.8800 |
| −0.2732 | −0.2402 | 4.8800 |
| −0.2713 | −0.2396 | 4.8800 |
| −0.2695 | −0.2391 | 4.8800 |
| −0.2676 | −0.2386 | 4.8800 |
| −0.2658 | −0.2380 | 4.8800 |
| −0.2639 | −0.2375 | 4.8800 |
| −0.2621 | −0.2370 | 4.8800 |
| −0.2529 | −0.2342 | 4.8800 |
| −0.2438 | −0.2312 | 4.8800 |
| −0.2347 | −0.2282 | 4.8800 |
| −0.2256 | −0.2250 | 4.8800 |
| −0.2166 | −0.2217 | 4.8800 |
| −0.2076 | −0.2183 | 4.8800 |
| −0.1987 | −0.2148 | 4.8800 |
| −0.1898 | −0.2112 | 4.8800 |
| −0.1809 | −0.2074 | 4.8800 |
| −0.1721 | −0.2036 | 4.8800 |
| −0.1634 | −0.1997 | 4.8800 |
| −0.1547 | −0.1956 | 4.8800 |
| −0.1460 | −0.1915 | 4.8800 |
| −0.1374 | −0.1873 | 4.8800 |
| −0.1288 | −0.1830 | 4.8800 |
| −0.1203 | −0.1786 | 4.8800 |
| −0.1118 | −0.1741 | 4.8800 |
| −0.1033 | −0.1696 | 4.8800 |
| −0.0949 | −0.1649 | 4.8800 |
| −0.0866 | −0.1602 | 4.8800 |
| −0.0782 | −0.1554 | 4.8800 |
| −0.0700 | −0.1505 | 4.8800 |
| −0.0617 | −0.1456 | 4.8800 |
| −0.0535 | −0.1406 | 4.8800 |
| −0.0454 | −0.1355 | 4.8800 |
| −0.0373 | −0.1304 | 4.8800 |
| −0.0292 | −0.1252 | 4.8800 |
| −0.0212 | −0.1199 | 4.8800 |
| −0.0132 | −0.1146 | 4.8800 |
| −0.0053 | −0.1092 | 4.8800 |
| 0.0026 | −0.1037 | 4.8800 |
| 0.0105 | −0.0982 | 4.8800 |
| 0.0183 | −0.0927 | 4.8800 |
| 0.0261 | −0.0871 | 4.8800 |
| 0.0339 | −0.0814 | 4.8800 |
| 0.0416 | −0.0757 | 4.8800 |
| 0.0493 | −0.0700 | 4.8800 |
| 0.0569 | −0.0641 | 4.8800 |
| 0.0645 | −0.0583 | 4.8800 |
| 0.0721 | −0.0524 | 4.8800 |

TABLE 2-continued

| X | Y | Z |
|---|---|---|
| 0.0796 | −0.0464 | 4.8800 |
| 0.0871 | −0.0404 | 4.8800 |
| 0.0946 | −0.0344 | 4.8800 |
| 0.1020 | −0.0283 | 4.8800 |
| 0.1094 | −0.0221 | 4.8800 |
| 0.1167 | −0.0159 | 4.8800 |
| 0.1240 | −0.0097 | 4.8800 |
| 0.1312 | −0.0034 | 4.8800 |
| 0.1384 | 0.0029 | 4.8800 |
| 0.1456 | 0.0094 | 4.8800 |
| 0.1527 | 0.0158 | 4.8800 |
| 0.1597 | 0.0224 | 4.8800 |
| 0.1667 | 0.0289 | 4.8800 |
| 0.1736 | 0.0356 | 4.8800 |
| 0.1805 | 0.0423 | 4.8800 |
| 0.1873 | 0.0491 | 4.8800 |
| 0.1940 | 0.0559 | 4.8800 |
| 0.2007 | 0.0628 | 4.8800 |
| 0.2073 | 0.0698 | 4.8800 |
| 0.2138 | 0.0768 | 4.8800 |
| 0.2203 | 0.0839 | 4.8800 |
| 0.2267 | 0.0911 | 4.8800 |
| 0.2330 | 0.0983 | 4.8800 |
| 0.2393 | 0.1056 | 4.8800 |
| 0.2455 | 0.1129 | 4.8800 |
| 0.2517 | 0.1203 | 4.8800 |
| 0.2577 | 0.1277 | 4.8800 |
| 0.2638 | 0.1352 | 4.8800 |
| 0.2697 | 0.1427 | 4.8800 |
| 0.2756 | 0.1503 | 4.8800 |
| 0.2815 | 0.1579 | 4.8800 |
| 0.2873 | 0.1655 | 4.8800 |
| 0.2930 | 0.1732 | 4.8800 |
| 0.2987 | 0.1809 | 4.8800 |
| 0.3044 | 0.1887 | 4.8800 |
| 0.3100 | 0.1965 | 4.8800 |
| 0.3156 | 0.2043 | 4.8800 |
| 0.3212 | 0.2121 | 4.8800 |
| 0.3267 | 0.2199 | 4.8800 |
| 0.3278 | 0.2215 | 4.8800 |
| 0.3289 | 0.2231 | 4.8800 |
| 0.3300 | 0.2246 | 4.8800 |
| 0.3312 | 0.2262 | 4.8800 |
| 0.3323 | 0.2278 | 4.8800 |
| 0.3334 | 0.2294 | 4.8800 |
| 0.3345 | 0.2309 | 4.8800 |
| 0.3356 | 0.2325 | 4.8800 |
| 0.3367 | 0.2341 | 4.8800 |
| 0.3377 | 0.2357 | 4.8800 |
| 0.3386 | 0.2372 | 4.8800 |
| 0.3393 | 0.2388 | 4.8800 |
| 0.3396 | 0.2406 | 4.8800 |
| 0.3397 | 0.2423 | 4.8800 |
| 0.3396 | 0.2441 | 4.8800 |
| 0.3391 | 0.2458 | 4.8800 |
| 0.3384 | 0.2474 | 4.8800 |
| 0.3374 | 0.2489 | 4.8800 |
| 0.3362 | 0.2502 | 4.8800 |
| 0.3348 | 0.2513 | 4.8800 |
| 0.3333 | 0.2521 | 4.8800 |
| 0.3316 | 0.2527 | 4.8800 |
| 0.3299 | 0.2530 | 4.8800 |
| 0.3281 | 0.2530 | 4.8800 |
| 0.3263 | 0.2527 | 4.8800 |
| 0.3247 | 0.2522 | 4.8800 |
| 0.3231 | 0.2514 | 4.8800 |
| 0.3217 | 0.2503 | 4.8800 |
| 0.3205 | 0.2490 | 4.8800 |
| 0.3193 | 0.2476 | 4.8800 |
| 0.3181 | 0.2461 | 4.8800 |
| 0.3170 | 0.2447 | 4.8800 |
| 0.3158 | 0.2433 | 4.8800 |
| 0.3146 | 0.2418 | 4.8800 |
| 0.3134 | 0.2404 | 4.8800 |
| 0.3122 | 0.2390 | 4.8800 |
| 0.3110 | 0.2376 | 4.8800 |
| 0.3098 | 0.2362 | 4.8800 |
| 0.3085 | 0.2348 | 4.8800 |

TABLE 2-continued

| X | Y | Z |
|---|---|---|
| 0.3024 | 0.2279 | 4.8800 |
| 0.2960 | 0.2211 | 4.8800 |
| 0.2896 | 0.2143 | 4.8800 |
| 0.2831 | 0.2077 | 4.8800 |
| 0.2764 | 0.2012 | 4.8800 |
| 0.2697 | 0.1948 | 4.8800 |
| 0.2629 | 0.1885 | 4.8800 |
| 0.2561 | 0.1822 | 4.8800 |
| 0.2491 | 0.1760 | 4.8800 |
| 0.2421 | 0.1699 | 4.8800 |
| 0.2351 | 0.1638 | 4.8800 |
| 0.2280 | 0.1578 | 4.8800 |
| 0.2209 | 0.1519 | 4.8800 |
| 0.2137 | 0.1460 | 4.8800 |
| 0.2065 | 0.1401 | 4.8800 |
| 0.1992 | 0.1343 | 4.8800 |
| 0.1919 | 0.1285 | 4.8800 |
| 0.1846 | 0.1228 | 4.8800 |
| 0.1773 | 0.1171 | 4.8800 |
| 0.1699 | 0.1114 | 4.8800 |
| 0.1625 | 0.1058 | 4.8800 |
| 0.1551 | 0.1002 | 4.8800 |
| 0.1476 | 0.0947 | 4.8800 |
| 0.1402 | 0.0891 | 4.8800 |
| 0.1327 | 0.0836 | 4.8800 |
| 0.1252 | 0.0782 | 4.8800 |
| 0.1176 | 0.0727 | 4.8800 |
| 0.1101 | 0.0673 | 4.8800 |
| 0.1025 | 0.0619 | 4.8800 |
| 0.0949 | 0.0566 | 4.8800 |
| 0.0873 | 0.0512 | 4.8800 |
| 0.0797 | 0.0459 | 4.8800 |
| 0.0720 | 0.0407 | 4.8800 |
| 0.0643 | 0.0354 | 4.8800 |
| 0.0566 | 0.0302 | 4.8800 |
| 0.0489 | 0.0250 | 4.8800 |
| 0.0412 | 0.0199 | 4.8800 |
| 0.0335 | 0.0148 | 4.8800 |
| 0.0257 | 0.0097 | 4.8800 |
| 0.0179 | 0.0046 | 4.8800 |
| 0.0101 | −0.0004 | 4.8800 |
| 0.0023 | −0.0054 | 4.8800 |
| −0.0056 | −0.0104 | 4.8800 |
| −0.0134 | −0.0153 | 4.8800 |
| −0.0213 | −0.0202 | 4.8800 |
| −0.0292 | −0.0251 | 4.8800 |
| −0.0372 | −0.0299 | 4.8800 |
| −0.0451 | −0.0347 | 4.8800 |
| −0.0531 | −0.0395 | 4.8800 |
| −0.0611 | −0.0443 | 4.8800 |
| −0.0691 | −0.0490 | 4.8800 |
| −0.0771 | −0.0537 | 4.8800 |
| −0.0851 | −0.0584 | 4.8800 |
| −0.0931 | −0.0631 | 4.8800 |
| −0.1012 | −0.0678 | 4.8800 |
| −0.1092 | −0.0724 | 4.8800 |
| −0.1173 | −0.0771 | 4.8800 |
| −0.1253 | −0.0817 | 4.8800 |
| −0.1334 | −0.0863 | 4.8800 |
| −0.1414 | −0.0910 | 4.8800 |
| −0.1495 | −0.0956 | 4.8800 |
| −0.1575 | −0.1003 | 4.8800 |
| −0.1655 | −0.1050 | 4.8800 |
| −0.1735 | −0.1097 | 4.8800 |
| −0.1815 | −0.1144 | 4.8800 |
| −0.1895 | −0.1192 | 4.8800 |
| −0.1974 | −0.1241 | 4.8800 |
| −0.2053 | −0.1290 | 4.8800 |
| −0.2132 | −0.1339 | 4.8800 |
| −0.2210 | −0.1389 | 4.8800 |
| −0.2288 | −0.1440 | 4.8800 |
| −0.2365 | −0.1492 | 4.8800 |
| −0.2442 | −0.1545 | 4.8800 |
| −0.2517 | −0.1598 | 4.8800 |
| −0.2592 | −0.1653 | 4.8800 |
| −0.2666 | −0.1710 | 4.8800 |
| −0.2739 | −0.1767 | 4.8800 |
| −0.2811 | −0.1826 | 4.8800 |

TABLE 2-continued

| X | Y | Z |
|---|---|---|
| −0.2881 | −0.1887 | 4.8800 |
| −0.2895 | −0.1899 | 4.8800 |
| −0.2909 | −0.1912 | 4.8800 |
| −0.2923 | −0.1924 | 4.8800 |
| −0.2936 | −0.1937 | 4.8800 |
| −0.2950 | −0.1949 | 4.8800 |
| −0.2964 | −0.1962 | 4.8800 |
| −0.2977 | −0.1975 | 4.8800 |
| −0.2990 | −0.1988 | 4.8800 |
| −0.3004 | −0.2001 | 4.8800 |
| −0.3017 | −0.2014 | 4.8800 |
| −0.3043 | −0.2041 | 4.8800 |
| −0.3067 | −0.2069 | 4.8800 |
| −0.3088 | −0.2100 | 4.8800 |
| −0.3106 | −0.2133 | 4.8800 |
| −0.3121 | −0.2167 | 4.8800 |
| −0.3132 | −0.2203 | 4.8800 |
| −0.3137 | −0.2240 | 4.8800 |
| −0.3137 | −0.2277 | 4.8800 |
| −0.3128 | −0.2314 | 4.8800 |
| −0.3112 | −0.2348 | 4.8800 |
| −0.3089 | −0.2377 | 4.8800 |
| −0.3060 | −0.2400 | 4.8800 |
| −0.3026 | −0.2417 | 4.8800 |
| −0.2991 | −0.2429 | 4.8800 |
| −0.2954 | −0.2435 | 4.8800 |
| −0.2917 | −0.2437 | 4.8800 |
| −0.2879 | −0.2435 | 4.8800 |
| −0.2842 | −0.2430 | 4.8800 |
| | SECTION 3 | |
| −0.2987 | −0.2870 | 5.0900 |
| −0.2968 | −0.2864 | 5.0900 |
| −0.2948 | −0.2858 | 5.0900 |
| −0.2928 | −0.2852 | 5.0900 |
| −0.2908 | −0.2845 | 5.0900 |
| −0.2889 | −0.2839 | 5.0900 |
| −0.2869 | −0.2832 | 5.0900 |
| −0.2849 | −0.2826 | 5.0900 |
| −0.2829 | −0.2820 | 5.0900 |
| −0.2810 | −0.2813 | 5.0900 |
| −0.2790 | −0.2806 | 5.0900 |
| −0.2692 | −0.2772 | 5.0900 |
| −0.2594 | −0.2737 | 5.0900 |
| −0.2497 | −0.2701 | 5.0900 |
| −0.2401 | −0.2663 | 5.0900 |
| −0.2304 | −0.2624 | 5.0900 |
| −0.2209 | −0.2584 | 5.0900 |
| −0.2113 | −0.2543 | 5.0900 |
| −0.2019 | −0.2501 | 5.0900 |
| −0.1924 | −0.2458 | 5.0900 |
| −0.1831 | −0.2413 | 5.0900 |
| −0.1737 | −0.2368 | 5.0900 |
| −0.1645 | −0.2321 | 5.0900 |
| −0.1552 | −0.2274 | 5.0900 |
| −0.1461 | −0.2225 | 5.0900 |
| −0.1369 | −0.2176 | 5.0900 |
| −0.1279 | −0.2126 | 5.0900 |
| −0.1188 | −0.2075 | 5.0900 |
| −0.1099 | −0.2023 | 5.0900 |
| −0.1009 | −0.1970 | 5.0900 |
| −0.0921 | −0.1916 | 5.0900 |
| −0.0832 | −0.1861 | 5.0900 |
| −0.0745 | −0.1806 | 5.0900 |
| −0.0657 | −0.1750 | 5.0900 |
| −0.0571 | −0.1693 | 5.0900 |
| −0.0484 | −0.1636 | 5.0900 |
| −0.0398 | −0.1577 | 5.0900 |
| −0.0313 | −0.1518 | 5.0900 |
| −0.0228 | −0.1459 | 5.0900 |
| −0.0144 | −0.1398 | 5.0900 |
| −0.0060 | −0.1337 | 5.0900 |
| 0.0023 | −0.1276 | 5.0900 |
| 0.0106 | −0.1213 | 5.0900 |
| 0.0189 | −0.1150 | 5.0900 |
| 0.0271 | −0.1087 | 5.0900 |
| 0.0352 | −0.1022 | 5.0900 |
| 0.0433 | −0.0958 | 5.0900 |

TABLE 2-continued

| X | Y | Z |
|---|---|---|
| 0.0514 | −0.0892 | 5.0900 |
| 0.0594 | −0.0826 | 5.0900 |
| 0.0673 | −0.0759 | 5.0900 |
| 0.0752 | −0.0692 | 5.0900 |
| 0.0831 | −0.0624 | 5.0900 |
| 0.0909 | −0.0556 | 5.0900 |
| 0.0986 | −0.0487 | 5.0900 |
| 0.1064 | −0.0418 | 5.0900 |
| 0.1140 | −0.0348 | 5.0900 |
| 0.1217 | −0.0278 | 5.0900 |
| 0.1292 | −0.0207 | 5.0900 |
| 0.1368 | −0.0136 | 5.0900 |
| 0.1442 | −0.0064 | 5.0900 |
| 0.1517 | 0.0009 | 5.0900 |
| 0.1590 | 0.0082 | 5.0900 |
| 0.1663 | 0.0156 | 5.0900 |
| 0.1736 | 0.0230 | 5.0900 |
| 0.1807 | 0.0305 | 5.0900 |
| 0.1879 | 0.0380 | 5.0900 |
| 0.1949 | 0.0456 | 5.0900 |
| 0.2019 | 0.0533 | 5.0900 |
| 0.2088 | 0.0611 | 5.0900 |
| 0.2156 | 0.0689 | 5.0900 |
| 0.2224 | 0.0767 | 5.0900 |
| 0.2291 | 0.0846 | 5.0900 |
| 0.2357 | 0.0926 | 5.0900 |
| 0.2423 | 0.1007 | 5.0900 |
| 0.2488 | 0.1087 | 5.0900 |
| 0.2552 | 0.1169 | 5.0900 |
| 0.2616 | 0.1251 | 5.0900 |
| 0.2679 | 0.1333 | 5.0900 |
| 0.2741 | 0.1416 | 5.0900 |
| 0.2802 | 0.1500 | 5.0900 |
| 0.2864 | 0.1584 | 5.0900 |
| 0.2924 | 0.1668 | 5.0900 |
| 0.2984 | 0.1753 | 5.0900 |
| 0.3043 | 0.1838 | 5.0900 |
| 0.3102 | 0.1923 | 5.0900 |
| 0.3161 | 0.2009 | 5.0900 |
| 0.3218 | 0.2095 | 5.0900 |
| 0.3276 | 0.2181 | 5.0900 |
| 0.3333 | 0.2268 | 5.0900 |
| 0.3390 | 0.2355 | 5.0900 |
| 0.3401 | 0.2372 | 5.0900 |
| 0.3413 | 0.2389 | 5.0900 |
| 0.3424 | 0.2407 | 5.0900 |
| 0.3435 | 0.2424 | 5.0900 |
| 0.3446 | 0.2442 | 5.0900 |
| 0.3458 | 0.2459 | 5.0900 |
| 0.3469 | 0.2477 | 5.0900 |
| 0.3480 | 0.2494 | 5.0900 |
| 0.3491 | 0.2511 | 5.0900 |
| 0.3503 | 0.2529 | 5.0900 |
| 0.3511 | 0.2544 | 5.0900 |
| 0.3517 | 0.2561 | 5.0900 |
| 0.3520 | 0.2578 | 5.0900 |
| 0.3520 | 0.2596 | 5.0900 |
| 0.3518 | 0.2613 | 5.0900 |
| 0.3513 | 0.2630 | 5.0900 |
| 0.3505 | 0.2646 | 5.0900 |
| 0.3495 | 0.2660 | 5.0900 |
| 0.3483 | 0.2673 | 5.0900 |
| 0.3469 | 0.2683 | 5.0900 |
| 0.3453 | 0.2691 | 5.0900 |
| 0.3437 | 0.2697 | 5.0900 |
| 0.3419 | 0.2699 | 5.0900 |
| 0.3402 | 0.2699 | 5.0900 |
| 0.3384 | 0.2696 | 5.0900 |
| 0.3368 | 0.2690 | 5.0900 |
| 0.3353 | 0.2681 | 5.0900 |
| 0.3339 | 0.2670 | 5.0900 |
| 0.3328 | 0.2657 | 5.0900 |
| 0.3315 | 0.2641 | 5.0900 |
| 0.3303 | 0.2625 | 5.0900 |
| 0.3291 | 0.2609 | 5.0900 |
| 0.3279 | 0.2593 | 5.0900 |
| 0.3266 | 0.2577 | 5.0900 |
| 0.3254 | 0.2561 | 5.0900 |

TABLE 2-continued

| X | Y | Z |
|---|---|---|
| 0.3241 | 0.2545 | 5.0900 |
| 0.3229 | 0.2530 | 5.0900 |
| 0.3216 | 0.2514 | 5.0900 |
| 0.3203 | 0.2498 | 5.0900 |
| 0.3139 | 0.2421 | 5.0900 |
| 0.3074 | 0.2344 | 5.0900 |
| 0.3007 | 0.2269 | 5.0900 |
| 0.2939 | 0.2195 | 5.0900 |
| 0.2870 | 0.2121 | 5.0900 |
| 0.2801 | 0.2048 | 5.0900 |
| 0.2730 | 0.1976 | 5.0900 |
| 0.2659 | 0.1905 | 5.0900 |
| 0.2587 | 0.1834 | 5.0900 |
| 0.2515 | 0.1765 | 5.0900 |
| 0.2442 | 0.1695 | 5.0900 |
| 0.2368 | 0.1626 | 5.0900 |
| 0.2294 | 0.1558 | 5.0900 |
| 0.2219 | 0.1491 | 5.0900 |
| 0.2144 | 0.1423 | 5.0900 |
| 0.2069 | 0.1357 | 5.0900 |
| 0.1993 | 0.1291 | 5.0900 |
| 0.1917 | 0.1225 | 5.0900 |
| 0.1840 | 0.1159 | 5.0900 |
| 0.1763 | 0.1094 | 5.0900 |
| 0.1686 | 0.1030 | 5.0900 |
| 0.1608 | 0.0966 | 5.0900 |
| 0.1530 | 0.0902 | 5.0900 |
| 0.1452 | 0.0839 | 5.0900 |
| 0.1373 | 0.0776 | 5.0900 |
| 0.1294 | 0.0713 | 5.0900 |
| 0.1215 | 0.0651 | 5.0900 |
| 0.1136 | 0.0589 | 5.0900 |
| 0.1056 | 0.0528 | 5.0900 |
| 0.0976 | 0.0467 | 5.0900 |
| 0.0895 | 0.0406 | 5.0900 |
| 0.0815 | 0.0346 | 5.0900 |
| 0.0734 | 0.0286 | 5.0900 |
| 0.0653 | 0.0226 | 5.0900 |
| 0.0571 | 0.0167 | 5.0900 |
| 0.0489 | 0.0108 | 5.0900 |
| 0.0407 | 0.0050 | 5.0900 |
| 0.0325 | −0.0008 | 5.0900 |
| 0.0242 | −0.0066 | 5.0900 |
| 0.0159 | −0.0123 | 5.0900 |
| 0.0075 | −0.0180 | 5.0900 |
| −0.0007 | −0.0236 | 5.0900 |
| −0.0091 | −0.0292 | 5.0900 |
| −0.0175 | −0.0348 | 5.0900 |
| −0.0259 | −0.0403 | 5.0900 |
| −0.0344 | −0.0458 | 5.0900 |
| −0.0429 | −0.0512 | 5.0900 |
| −0.0513 | −0.0566 | 5.0900 |
| −0.0599 | −0.0620 | 5.0900 |
| −0.0684 | −0.0673 | 5.0900 |
| −0.0769 | −0.0727 | 5.0900 |
| −0.0855 | −0.0780 | 5.0900 |
| −0.0941 | −0.0832 | 5.0900 |
| −0.1027 | −0.0885 | 5.0900 |
| −0.1112 | −0.0938 | 5.0900 |
| −0.1198 | −0.0990 | 5.0900 |
| −0.1285 | −0.1043 | 5.0900 |
| −0.1371 | −0.1095 | 5.0900 |
| −0.1456 | −0.1148 | 5.0900 |
| −0.1542 | −0.1200 | 5.0900 |
| −0.1628 | −0.1253 | 5.0900 |
| −0.1714 | −0.1306 | 5.0900 |
| −0.1799 | −0.1360 | 5.0900 |
| −0.1884 | −0.1414 | 5.0900 |
| −0.1968 | −0.1468 | 5.0900 |
| −0.2053 | −0.1523 | 5.0900 |
| −0.2137 | −0.1579 | 5.0900 |
| −0.2220 | −0.1635 | 5.0900 |
| −0.2303 | −0.1692 | 5.0900 |
| −0.2386 | −0.1750 | 5.0900 |
| −0.2467 | −0.1809 | 5.0900 |
| −0.2548 | −0.1870 | 5.0900 |
| −0.2628 | −0.1931 | 5.0900 |
| −0.2706 | −0.1994 | 5.0900 |

TABLE 2-continued

| X | Y | Z |
|---|---|---|
| −0.2784 | −0.2058 | 5.0900 |
| −0.2860 | −0.2124 | 5.0900 |
| −0.2935 | −0.2192 | 5.0900 |
| −0.3008 | −0.2261 | 5.0900 |
| −0.3079 | −0.2332 | 5.0900 |
| −0.3093 | −0.2347 | 5.0900 |
| −0.3107 | −0.2361 | 5.0900 |
| −0.3121 | −0.2376 | 5.0900 |
| −0.3134 | −0.2391 | 5.0900 |
| −0.3148 | −0.2406 | 5.0900 |
| −0.3161 | −0.2421 | 5.0900 |
| −0.3175 | −0.2436 | 5.0900 |
| −0.3188 | −0.2451 | 5.0900 |
| −0.3202 | −0.2466 | 5.0900 |
| −0.3215 | −0.2481 | 5.0900 |
| −0.3238 | −0.2509 | 5.0900 |
| −0.3258 | −0.2538 | 5.0900 |
| −0.3276 | −0.2570 | 5.0900 |
| −0.3292 | −0.2602 | 5.0900 |
| −0.3304 | −0.2636 | 5.0900 |
| −0.3312 | −0.2671 | 5.0900 |
| −0.3315 | −0.2707 | 5.0900 |
| −0.3312 | −0.2743 | 5.0900 |
| −0.3303 | −0.2778 | 5.0900 |
| −0.3286 | −0.2810 | 5.0900 |
| −0.3262 | −0.2837 | 5.0900 |
| −0.3233 | −0.2858 | 5.0900 |
| −0.3200 | −0.2874 | 5.0900 |
| −0.3166 | −0.2883 | 5.0900 |
| −0.3130 | −0.2888 | 5.0900 |
| −0.3094 | −0.2889 | 5.0900 |
| −0.3058 | −0.2885 | 5.0900 |
| −0.3022 | −0.2879 | 5.0900 |
| SECTION 4 | | |
| −0.3230 | −0.3274 | 5.3000 |
| −0.3209 | −0.3267 | 5.3000 |
| −0.3188 | −0.3261 | 5.3000 |
| −0.3167 | −0.3254 | 5.3000 |
| −0.3145 | −0.3247 | 5.3000 |
| −0.3124 | −0.3240 | 5.3000 |
| −0.3103 | −0.3233 | 5.3000 |
| −0.3082 | −0.3226 | 5.3000 |
| −0.3061 | −0.3219 | 5.3000 |
| −0.3039 | −0.3212 | 5.3000 |
| −0.3018 | −0.3205 | 5.3000 |
| −0.2913 | −0.3168 | 5.3000 |
| −0.2808 | −0.3129 | 5.3000 |
| −0.2704 | −0.3090 | 5.3000 |
| −0.2600 | −0.3048 | 5.3000 |
| −0.2497 | −0.3005 | 5.3000 |
| −0.2395 | −0.2961 | 5.3000 |
| −0.2293 | −0.2916 | 5.3000 |
| −0.2192 | −0.2869 | 5.3000 |
| −0.2091 | −0.2821 | 5.3000 |
| −0.1991 | −0.2772 | 5.3000 |
| −0.1891 | −0.2722 | 5.3000 |
| −0.1792 | −0.2671 | 5.3000 |
| −0.1694 | −0.2618 | 5.3000 |
| −0.1596 | −0.2565 | 5.3000 |
| −0.1498 | −0.2510 | 5.3000 |
| −0.1402 | −0.2454 | 5.3000 |
| −0.1306 | −0.2398 | 5.3000 |
| −0.1210 | −0.2340 | 5.3000 |
| −0.1115 | −0.2281 | 5.3000 |
| −0.1021 | −0.2222 | 5.3000 |
| −0.0927 | −0.2161 | 5.3000 |
| −0.0834 | −0.2100 | 5.3000 |
| −0.0742 | −0.2037 | 5.3000 |
| −0.0650 | −0.1974 | 5.3000 |
| −0.0558 | −0.1910 | 5.3000 |
| −0.0468 | −0.1845 | 5.3000 |
| −0.0377 | −0.1780 | 5.3000 |
| −0.0288 | −0.1713 | 5.3000 |
| −0.0199 | −0.1646 | 5.3000 |
| −0.0110 | −0.1578 | 5.3000 |
| −0.0023 | −0.1509 | 5.3000 |
| 0.0065 | −0.1440 | 5.3000 |

TABLE 2-continued

| X | Y | Z |
|---|---|---|
| 0.0151 | −0.1369 | 5.3000 |
| 0.0237 | −0.1298 | 5.3000 |
| 0.0323 | −0.1227 | 5.3000 |
| 0.0408 | −0.1154 | 5.3000 |
| 0.0492 | −0.1081 | 5.3000 |
| 0.0576 | −0.1008 | 5.3000 |
| 0.0659 | −0.0933 | 5.3000 |
| 0.0742 | −0.0858 | 5.3000 |
| 0.0824 | −0.0783 | 5.3000 |
| 0.0905 | −0.0706 | 5.3000 |
| 0.0986 | −0.0630 | 5.3000 |
| 0.1066 | −0.0552 | 5.3000 |
| 0.1146 | −0.0474 | 5.3000 |
| 0.1226 | −0.0396 | 5.3000 |
| 0.1304 | −0.0317 | 5.3000 |
| 0.1383 | −0.0237 | 5.3000 |
| 0.1460 | −0.0157 | 5.3000 |
| 0.1537 | −0.0076 | 5.3000 |
| 0.1614 | 0.0005 | 5.3000 |
| 0.1689 | 0.0087 | 5.3000 |
| 0.1764 | 0.0169 | 5.3000 |
| 0.1839 | 0.0253 | 5.3000 |
| 0.1912 | 0.0336 | 5.3000 |
| 0.1985 | 0.0421 | 5.3000 |
| 0.2058 | 0.0506 | 5.3000 |
| 0.2129 | 0.0591 | 5.3000 |
| 0.2200 | 0.0677 | 5.3000 |
| 0.2270 | 0.0764 | 5.3000 |
| 0.2340 | 0.0851 | 5.3000 |
| 0.2409 | 0.0939 | 5.3000 |
| 0.2477 | 0.1028 | 5.3000 |
| 0.2544 | 0.1117 | 5.3000 |
| 0.2610 | 0.1206 | 5.3000 |
| 0.2676 | 0.1297 | 5.3000 |
| 0.2741 | 0.1387 | 5.3000 |
| 0.2806 | 0.1478 | 5.3000 |
| 0.2869 | 0.1570 | 5.3000 |
| 0.2932 | 0.1662 | 5.3000 |
| 0.2995 | 0.1754 | 5.3000 |
| 0.3057 | 0.1847 | 5.3000 |
| 0.3118 | 0.1940 | 5.3000 |
| 0.3179 | 0.2034 | 5.3000 |
| 0.3239 | 0.2128 | 5.3000 |
| 0.3298 | 0.2222 | 5.3000 |
| 0.3357 | 0.2317 | 5.3000 |
| 0.3416 | 0.2412 | 5.3000 |
| 0.3474 | 0.2507 | 5.3000 |
| 0.3486 | 0.2526 | 5.3000 |
| 0.3497 | 0.2545 | 5.3000 |
| 0.3509 | 0.2564 | 5.3000 |
| 0.3520 | 0.2583 | 5.3000 |
| 0.3532 | 0.2603 | 5.3000 |
| 0.3543 | 0.2622 | 5.3000 |
| 0.3555 | 0.2641 | 5.3000 |
| 0.3566 | 0.2660 | 5.3000 |
| 0.3578 | 0.2679 | 5.3000 |
| 0.3589 | 0.2698 | 5.3000 |
| 0.3597 | 0.2714 | 5.3000 |
| 0.3602 | 0.2731 | 5.3000 |
| 0.3605 | 0.2748 | 5.3000 |
| 0.3605 | 0.2765 | 5.3000 |
| 0.3602 | 0.2782 | 5.3000 |
| 0.3597 | 0.2799 | 5.3000 |
| 0.3589 | 0.2815 | 5.3000 |
| 0.3578 | 0.2829 | 5.3000 |
| 0.3566 | 0.2841 | 5.3000 |
| 0.3552 | 0.2851 | 5.3000 |
| 0.3536 | 0.2859 | 5.3000 |
| 0.3520 | 0.2864 | 5.3000 |
| 0.3502 | 0.2866 | 5.3000 |
| 0.3485 | 0.2865 | 5.3000 |
| 0.3468 | 0.2862 | 5.3000 |
| 0.3451 | 0.2855 | 5.3000 |
| 0.3437 | 0.2846 | 5.3000 |
| 0.3424 | 0.2835 | 5.3000 |
| 0.3412 | 0.2821 | 5.3000 |
| 0.3400 | 0.2804 | 5.3000 |
| 0.3387 | 0.2786 | 5.3000 |

TABLE 2-continued

| X | Y | Z |
|---|---|---|
| 0.3374 | 0.2769 | 5.3000 |
| 0.3362 | 0.2751 | 5.3000 |
| 0.3349 | 0.2734 | 5.3000 |
| 0.3336 | 0.2716 | 5.3000 |
| 0.3323 | 0.2699 | 5.3000 |
| 0.3310 | 0.2681 | 5.3000 |
| 0.3297 | 0.2664 | 5.3000 |
| 0.3284 | 0.2647 | 5.3000 |
| 0.3217 | 0.2561 | 5.3000 |
| 0.3150 | 0.2477 | 5.3000 |
| 0.3081 | 0.2393 | 5.3000 |
| 0.3011 | 0.2310 | 5.3000 |
| 0.2940 | 0.2228 | 5.3000 |
| 0.2868 | 0.2147 | 5.3000 |
| 0.2796 | 0.2067 | 5.3000 |
| 0.2723 | 0.1987 | 5.3000 |
| 0.2649 | 0.1908 | 5.3000 |
| 0.2574 | 0.1829 | 5.3000 |
| 0.2499 | 0.1751 | 5.3000 |
| 0.2423 | 0.1674 | 5.3000 |
| 0.2347 | 0.1597 | 5.3000 |
| 0.2270 | 0.1521 | 5.3000 |
| 0.2192 | 0.1445 | 5.3000 |
| 0.2114 | 0.1370 | 5.3000 |
| 0.2036 | 0.1295 | 5.3000 |
| 0.1957 | 0.1221 | 5.3000 |
| 0.1878 | 0.1147 | 5.3000 |
| 0.1798 | 0.1074 | 5.3000 |
| 0.1717 | 0.1001 | 5.3000 |
| 0.1637 | 0.0929 | 5.3000 |
| 0.1556 | 0.0857 | 5.3000 |
| 0.1474 | 0.0786 | 5.3000 |
| 0.1392 | 0.0715 | 5.3000 |
| 0.1310 | 0.0645 | 5.3000 |
| 0.1227 | 0.0575 | 5.3000 |
| 0.1144 | 0.0506 | 5.3000 |
| 0.1060 | 0.0437 | 5.3000 |
| 0.0976 | 0.0369 | 5.3000 |
| 0.0891 | 0.0301 | 5.3000 |
| 0.0806 | 0.0234 | 5.3000 |
| 0.0721 | 0.0167 | 5.3000 |
| 0.0635 | 0.0101 | 5.3000 |
| 0.0549 | 0.0035 | 5.3000 |
| 0.0463 | −0.0030 | 5.3000 |
| 0.0376 | −0.0095 | 5.3000 |
| 0.0289 | −0.0159 | 5.3000 |
| 0.0201 | −0.0222 | 5.3000 |
| 0.0113 | −0.0286 | 5.3000 |
| 0.0025 | −0.0348 | 5.3000 |
| −0.0064 | −0.0410 | 5.3000 |
| −0.0153 | −0.0472 | 5.3000 |
| −0.0242 | −0.0533 | 5.3000 |
| −0.0332 | −0.0594 | 5.3000 |
| −0.0422 | −0.0654 | 5.3000 |
| −0.0512 | −0.0714 | 5.3000 |
| −0.0603 | −0.0774 | 5.3000 |
| −0.0694 | −0.0833 | 5.3000 |
| −0.0785 | −0.0892 | 5.3000 |
| −0.0876 | −0.0950 | 5.3000 |
| −0.0967 | −0.1008 | 5.3000 |
| −0.1059 | −0.1066 | 5.3000 |
| −0.1150 | −0.1124 | 5.3000 |
| −0.1242 | −0.1182 | 5.3000 |
| −0.1334 | −0.1240 | 5.3000 |
| −0.1425 | −0.1297 | 5.3000 |
| −0.1517 | −0.1355 | 5.3000 |
| −0.1608 | −0.1413 | 5.3000 |
| −0.1700 | −0.1471 | 5.3000 |
| −0.1791 | −0.1530 | 5.3000 |
| −0.1882 | −0.1588 | 5.3000 |
| −0.1973 | −0.1647 | 5.3000 |
| −0.2063 | −0.1707 | 5.3000 |
| −0.2153 | −0.1767 | 5.3000 |
| −0.2243 | −0.1828 | 5.3000 |
| −0.2332 | −0.1890 | 5.3000 |
| −0.2420 | −0.1952 | 5.3000 |
| −0.2508 | −0.2016 | 5.3000 |
| −0.2595 | −0.2081 | 5.3000 |

TABLE 2-continued

| X | Y | Z |
|---|---|---|
| −0.2681 | −0.2146 | 5.3000 |
| −0.2766 | −0.2214 | 5.3000 |
| −0.2850 | −0.2282 | 5.3000 |
| −0.2932 | −0.2352 | 5.3000 |
| −0.3013 | −0.2424 | 5.3000 |
| −0.3093 | −0.2498 | 5.3000 |
| −0.3170 | −0.2573 | 5.3000 |
| −0.3246 | −0.2651 | 5.3000 |
| −0.3319 | −0.2731 | 5.3000 |
| −0.3334 | −0.2747 | 5.3000 |
| −0.3348 | −0.2763 | 5.3000 |
| −0.3362 | −0.2779 | 5.3000 |
| −0.3376 | −0.2796 | 5.3000 |
| −0.3390 | −0.2812 | 5.3000 |
| −0.3404 | −0.2829 | 5.3000 |
| −0.3418 | −0.2846 | 5.3000 |
| −0.3432 | −0.2863 | 5.3000 |
| −0.3445 | −0.2880 | 5.3000 |
| −0.3459 | −0.2897 | 5.3000 |
| −0.3479 | −0.2925 | 5.3000 |
| −0.3498 | −0.2954 | 5.3000 |
| −0.3514 | −0.2984 | 5.3000 |
| −0.3528 | −0.3016 | 5.3000 |
| −0.3538 | −0.3050 | 5.3000 |
| −0.3545 | −0.3084 | 5.3000 |
| −0.3547 | −0.3118 | 5.3000 |
| −0.3544 | −0.3153 | 5.3000 |
| −0.3534 | −0.3186 | 5.3000 |
| −0.3517 | −0.3217 | 5.3000 |
| −0.3494 | −0.3243 | 5.3000 |
| −0.3467 | −0.3264 | 5.3000 |
| −0.3435 | −0.3278 | 5.3000 |
| −0.3402 | −0.3288 | 5.3000 |
| −0.3367 | −0.3292 | 5.3000 |
| −0.3333 | −0.3292 | 5.3000 |
| −0.3298 | −0.3289 | 5.3000 |
| −0.3264 | −0.3283 | 5.3000 |
| | Section 5 | |
| −0.3534 | −0.3634 | 5.5100 |
| −0.3511 | −0.3628 | 5.5100 |
| −0.3488 | −0.3621 | 5.5100 |
| −0.3465 | −0.3615 | 5.5100 |
| −0.3442 | −0.3608 | 5.5100 |
| −0.3419 | −0.3602 | 5.5100 |
| −0.3396 | −0.3595 | 5.5100 |
| −0.3373 | −0.3588 | 5.5100 |
| −0.3351 | −0.3581 | 5.5100 |
| −0.3328 | −0.3574 | 5.5100 |
| −0.3305 | −0.3567 | 5.5100 |
| −0.3191 | −0.3531 | 5.5100 |
| −0.3078 | −0.3492 | 5.5100 |
| −0.2966 | −0.3452 | 5.5100 |
| −0.2854 | −0.3409 | 5.5100 |
| −0.2743 | −0.3365 | 5.5100 |
| −0.2633 | −0.3319 | 5.5100 |
| −0.2523 | −0.3271 | 5.5100 |
| −0.2415 | −0.3222 | 5.5100 |
| −0.2307 | −0.3171 | 5.5100 |
| −0.2199 | −0.3119 | 5.5100 |
| −0.2092 | −0.3065 | 5.5100 |
| −0.1987 | −0.3010 | 5.5100 |
| −0.1881 | −0.2953 | 5.5100 |
| −0.1777 | −0.2895 | 5.5100 |
| −0.1673 | −0.2836 | 5.5100 |
| −0.1570 | −0.2776 | 5.5100 |
| −0.1468 | −0.2714 | 5.5100 |
| −0.1366 | −0.2651 | 5.5100 |
| −0.1266 | −0.2587 | 5.5100 |
| −0.1165 | −0.2522 | 5.5100 |
| −0.1066 | −0.2456 | 5.5100 |
| −0.0967 | −0.2388 | 5.5100 |
| −0.0869 | −0.2320 | 5.5100 |
| −0.0772 | −0.2251 | 5.5100 |
| −0.0676 | −0.2180 | 5.5100 |
| −0.0580 | −0.2109 | 5.5100 |
| −0.0485 | −0.2037 | 5.5100 |
| −0.0390 | −0.1963 | 5.5100 |

TABLE 2-continued

| X | Y | Z |
|---|---|---|
| −0.0297 | −0.1889 | 5.5100 |
| −0.0204 | −0.1814 | 5.5100 |
| −0.0111 | −0.1739 | 5.5100 |
| −0.0020 | −0.1662 | 5.5100 |
| 0.0071 | −0.1585 | 5.5100 |
| 0.0161 | −0.1506 | 5.5100 |
| 0.0251 | −0.1427 | 5.5100 |
| 0.0340 | −0.1347 | 5.5100 |
| 0.0428 | −0.1267 | 5.5100 |
| 0.0516 | −0.1186 | 5.5100 |
| 0.0603 | −0.1104 | 5.5100 |
| 0.0689 | −0.1021 | 5.5100 |
| 0.0775 | −0.0938 | 5.5100 |
| 0.0860 | −0.0854 | 5.5100 |
| 0.0944 | −0.0769 | 5.5100 |
| 0.1028 | −0.0684 | 5.5100 |
| 0.1111 | −0.0599 | 5.5100 |
| 0.1193 | −0.0512 | 5.5100 |
| 0.1275 | −0.0425 | 5.5100 |
| 0.1357 | −0.0338 | 5.5100 |
| 0.1437 | −0.0250 | 5.5100 |
| 0.1517 | −0.0161 | 5.5100 |
| 0.1597 | −0.0072 | 5.5100 |
| 0.1675 | 0.0018 | 5.5100 |
| 0.1753 | 0.0109 | 5.5100 |
| 0.1831 | 0.0200 | 5.5100 |
| 0.1907 | 0.0291 | 5.5100 |
| 0.1983 | 0.0384 | 5.5100 |
| 0.2058 | 0.0476 | 5.5100 |
| 0.2133 | 0.0570 | 5.5100 |
| 0.2206 | 0.0664 | 5.5100 |
| 0.2279 | 0.0759 | 5.5100 |
| 0.2351 | 0.0854 | 5.5100 |
| 0.2422 | 0.0950 | 5.5100 |
| 0.2493 | 0.1046 | 5.5100 |
| 0.2563 | 0.1143 | 5.5100 |
| 0.2632 | 0.1241 | 5.5100 |
| 0.2700 | 0.1339 | 5.5100 |
| 0.2767 | 0.1437 | 5.5100 |
| 0.2834 | 0.1537 | 5.5100 |
| 0.2900 | 0.1636 | 5.5100 |
| 0.2965 | 0.1736 | 5.5100 |
| 0.3029 | 0.1837 | 5.5100 |
| 0.3093 | 0.1938 | 5.5100 |
| 0.3156 | 0.2039 | 5.5100 |
| 0.3219 | 0.2141 | 5.5100 |
| 0.3280 | 0.2243 | 5.5100 |
| 0.3341 | 0.2346 | 5.5100 |
| 0.3402 | 0.2449 | 5.5100 |
| 0.3462 | 0.2553 | 5.5100 |
| 0.3521 | 0.2656 | 5.5100 |
| 0.3533 | 0.2677 | 5.5100 |
| 0.3544 | 0.2698 | 5.5100 |
| 0.3556 | 0.2719 | 5.5100 |
| 0.3568 | 0.2739 | 5.5100 |
| 0.3579 | 0.2760 | 5.5100 |
| 0.3591 | 0.2781 | 5.5100 |
| 0.3603 | 0.2802 | 5.5100 |
| 0.3614 | 0.2823 | 5.5100 |
| 0.3626 | 0.2844 | 5.5100 |
| 0.3638 | 0.2865 | 5.5100 |
| 0.3645 | 0.2880 | 5.5100 |
| 0.3649 | 0.2897 | 5.5100 |
| 0.3651 | 0.2914 | 5.5100 |
| 0.3651 | 0.2932 | 5.5100 |
| 0.3648 | 0.2949 | 5.5100 |
| 0.3642 | 0.2965 | 5.5100 |
| 0.3634 | 0.2980 | 5.5100 |
| 0.3623 | 0.2994 | 5.5100 |
| 0.3611 | 0.3006 | 5.5100 |
| 0.3597 | 0.3016 | 5.5100 |
| 0.3581 | 0.3024 | 5.5100 |
| 0.3564 | 0.3028 | 5.5100 |
| 0.3547 | 0.3030 | 5.5100 |
| 0.3530 | 0.3029 | 5.5100 |
| 0.3513 | 0.3025 | 5.5100 |
| 0.3497 | 0.3018 | 5.5100 |
| 0.3482 | 0.3009 | 5.5100 |

TABLE 2-continued

| X | Y | Z |
|---|---|---|
| 0.3470 | 0.2997 | 5.5100 |
| 0.3459 | 0.2984 | 5.5100 |
| 0.3446 | 0.2964 | 5.5100 |
| 0.3433 | 0.2945 | 5.5100 |
| 0.3420 | 0.2926 | 5.5100 |
| 0.3407 | 0.2907 | 5.5100 |
| 0.3393 | 0.2888 | 5.5100 |
| 0.3380 | 0.2869 | 5.5100 |
| 0.3367 | 0.2850 | 5.5100 |
| 0.3354 | 0.2832 | 5.5100 |
| 0.3340 | 0.2813 | 5.5100 |
| 0.3327 | 0.2794 | 5.5100 |
| 0.3259 | 0.2700 | 5.5100 |
| 0.3189 | 0.2608 | 5.5100 |
| 0.3119 | 0.2516 | 5.5100 |
| 0.3047 | 0.2425 | 5.5100 |
| 0.2975 | 0.2335 | 5.5100 |
| 0.2901 | 0.2245 | 5.5100 |
| 0.2827 | 0.2157 | 5.5100 |
| 0.2752 | 0.2069 | 5.5100 |
| 0.2676 | 0.1981 | 5.5100 |
| 0.2600 | 0.1894 | 5.5100 |
| 0.2523 | 0.1808 | 5.5100 |
| 0.2445 | 0.1722 | 5.5100 |
| 0.2367 | 0.1637 | 5.5100 |
| 0.2288 | 0.1553 | 5.5100 |
| 0.2209 | 0.1469 | 5.5100 |
| 0.2129 | 0.1385 | 5.5100 |
| 0.2048 | 0.1302 | 5.5100 |
| 0.1967 | 0.1220 | 5.5100 |
| 0.1885 | 0.1138 | 5.5100 |
| 0.1803 | 0.1057 | 5.5100 |
| 0.1720 | 0.0976 | 5.5100 |
| 0.1636 | 0.0896 | 5.5100 |
| 0.1552 | 0.0817 | 5.5100 |
| 0.1468 | 0.0738 | 5.5100 |
| 0.1383 | 0.0659 | 5.5100 |
| 0.1297 | 0.0581 | 5.5100 |
| 0.1211 | 0.0504 | 5.5100 |
| 0.1124 | 0.0428 | 5.5100 |
| 0.1037 | 0.0352 | 5.5100 |
| 0.0949 | 0.0277 | 5.5100 |
| 0.0861 | 0.0202 | 5.5100 |
| 0.0772 | 0.0128 | 5.5100 |
| 0.0682 | 0.0055 | 5.5100 |
| 0.0592 | −0.0018 | 5.5100 |
| 0.0502 | −0.0090 | 5.5100 |
| 0.0411 | −0.0161 | 5.5100 |
| 0.0319 | −0.0232 | 5.5100 |
| 0.0227 | −0.0302 | 5.5100 |
| 0.0135 | −0.0372 | 5.5100 |
| 0.0042 | −0.0441 | 5.5100 |
| −0.0051 | −0.0509 | 5.5100 |
| −0.0145 | −0.0576 | 5.5100 |
| −0.0239 | −0.0643 | 5.5100 |
| −0.0334 | −0.0710 | 5.5100 |
| −0.0429 | −0.0776 | 5.5100 |
| −0.0525 | −0.0841 | 5.5100 |
| −0.0620 | −0.0906 | 5.5100 |
| −0.0716 | −0.0971 | 5.5100 |
| −0.0813 | −0.1035 | 5.5100 |
| −0.0909 | −0.1098 | 5.5100 |
| −0.1006 | −0.1161 | 5.5100 |
| −0.1103 | −0.1224 | 5.5100 |
| −0.1200 | −0.1287 | 5.5100 |
| −0.1298 | −0.1350 | 5.5100 |
| −0.1395 | −0.1412 | 5.5100 |
| −0.1492 | −0.1474 | 5.5100 |
| −0.1590 | −0.1537 | 5.5100 |
| −0.1687 | −0.1599 | 5.5100 |
| −0.1785 | −0.1662 | 5.5100 |
| −0.1882 | −0.1725 | 5.5100 |
| −0.1979 | −0.1788 | 5.5100 |
| −0.2075 | −0.1851 | 5.5100 |
| −0.2172 | −0.1915 | 5.5100 |
| −0.2268 | −0.1979 | 5.5100 |
| −0.2364 | −0.2044 | 5.5100 |
| −0.2459 | −0.2110 | 5.5100 |

TABLE 2-continued

| X | Y | Z |
|---|---|---|
| −0.2553 | −0.2177 | 5.5100 |
| −0.2647 | −0.2244 | 5.5100 |
| −0.2740 | −0.2313 | 5.5100 |
| −0.2832 | −0.2383 | 5.5100 |
| −0.2924 | −0.2454 | 5.5100 |
| −0.3014 | −0.2526 | 5.5100 |
| −0.3103 | −0.2600 | 5.5100 |
| −0.3190 | −0.2676 | 5.5100 |
| −0.3276 | −0.2753 | 5.5100 |
| −0.3361 | −0.2832 | 5.5100 |
| −0.3443 | −0.2914 | 5.5100 |
| −0.3523 | −0.2997 | 5.5100 |
| −0.3601 | −0.3083 | 5.5100 |
| −0.3616 | −0.3100 | 5.5100 |
| −0.3632 | −0.3117 | 5.5100 |
| −0.3647 | −0.3135 | 5.5100 |
| −0.3661 | −0.3153 | 5.5100 |
| −0.3676 | −0.3170 | 5.5100 |
| −0.3691 | −0.3188 | 5.5100 |
| −0.3705 | −0.3206 | 5.5100 |
| −0.3720 | −0.3224 | 5.5100 |
| −0.3734 | −0.3242 | 5.5100 |
| −0.3748 | −0.3261 | 5.5100 |
| −0.3768 | −0.3288 | 5.5100 |
| −0.3786 | −0.3316 | 5.5100 |
| −0.3801 | −0.3345 | 5.5100 |
| −0.3814 | −0.3376 | 5.5100 |
| −0.3824 | −0.3408 | 5.5100 |
| −0.3831 | −0.3440 | 5.5100 |
| −0.3833 | −0.3474 | 5.5100 |
| −0.3830 | −0.3507 | 5.5100 |
| −0.3822 | −0.3539 | 5.5100 |
| −0.3807 | −0.3569 | 5.5100 |
| −0.3786 | −0.3594 | 5.5100 |
| −0.3760 | −0.3615 | 5.5100 |
| −0.3731 | −0.3631 | 5.5100 |
| −0.3699 | −0.3641 | 5.5100 |
| −0.3666 | −0.3647 | 5.5100 |
| −0.3633 | −0.3648 | 5.5100 |
| −0.3600 | −0.3646 | 5.5100 |
| −0.3567 | −0.3641 | 5.5100 |
| SECTION 6 | | |
| −0.3899 | −0.3950 | 5.7200 |
| −0.3875 | −0.3945 | 5.7200 |
| −0.3850 | −0.3941 | 5.7200 |
| −0.3825 | −0.3936 | 5.7200 |
| −0.3800 | −0.3931 | 5.7200 |
| −0.3775 | −0.3925 | 5.7200 |
| −0.3750 | −0.3920 | 5.7200 |
| −0.3725 | −0.3915 | 5.7200 |
| −0.3700 | −0.3909 | 5.7200 |
| −0.3675 | −0.3903 | 5.7200 |
| −0.3650 | −0.3898 | 5.7200 |
| −0.3527 | −0.3866 | 5.7200 |
| −0.3404 | −0.3832 | 5.7200 |
| −0.3282 | −0.3794 | 5.7200 |
| −0.3162 | −0.3754 | 5.7200 |
| −0.3042 | −0.3711 | 5.7200 |
| −0.2922 | −0.3666 | 5.7200 |
| −0.2804 | −0.3618 | 5.7200 |
| −0.2687 | −0.3568 | 5.7200 |
| −0.2571 | −0.3516 | 5.7200 |
| −0.2455 | −0.3462 | 5.7200 |
| −0.2341 | −0.3406 | 5.7200 |
| −0.2227 | −0.3348 | 5.7200 |
| −0.2115 | −0.3289 | 5.7200 |
| −0.2003 | −0.3227 | 5.7200 |
| −0.1893 | −0.3164 | 5.7200 |
| −0.1783 | −0.3099 | 5.7200 |
| −0.1674 | −0.3033 | 5.7200 |
| −0.1566 | −0.2965 | 5.7200 |
| −0.1459 | −0.2896 | 5.7200 |
| −0.1353 | −0.2825 | 5.7200 |
| −0.1248 | −0.2753 | 5.7200 |
| −0.1144 | −0.2680 | 5.7200 |
| −0.1041 | −0.2605 | 5.7200 |
| −0.0938 | −0.2529 | 5.7200 |

TABLE 2-continued

| X | Y | Z |
|---|---|---|
| −0.0837 | −0.2452 | 5.7200 |
| −0.0736 | −0.2374 | 5.7200 |
| −0.0636 | −0.2295 | 5.7200 |
| −0.0537 | −0.2215 | 5.7200 |
| −0.0439 | −0.2134 | 5.7200 |
| −0.0342 | −0.2051 | 5.7200 |
| −0.0245 | −0.1968 | 5.7200 |
| −0.0149 | −0.1884 | 5.7200 |
| −0.0054 | −0.1799 | 5.7200 |
| 0.0040 | −0.1714 | 5.7200 |
| 0.0134 | −0.1627 | 5.7200 |
| 0.0226 | −0.1540 | 5.7200 |
| 0.0318 | −0.1452 | 5.7200 |
| 0.0410 | −0.1363 | 5.7200 |
| 0.0501 | −0.1274 | 5.7200 |
| 0.0591 | −0.1183 | 5.7200 |
| 0.0680 | −0.1093 | 5.7200 |
| 0.0769 | −0.1001 | 5.7200 |
| 0.0857 | −0.0909 | 5.7200 |
| 0.0944 | −0.0816 | 5.7200 |
| 0.1030 | −0.0723 | 5.7200 |
| 0.1116 | −0.0628 | 5.7200 |
| 0.1202 | −0.0534 | 5.7200 |
| 0.1286 | −0.0438 | 5.7200 |
| 0.1370 | −0.0342 | 5.7200 |
| 0.1453 | −0.0246 | 5.7200 |
| 0.1535 | −0.0149 | 5.7200 |
| 0.1617 | −0.0051 | 5.7200 |
| 0.1698 | 0.0048 | 5.7200 |
| 0.1778 | 0.0147 | 5.7200 |
| 0.1858 | 0.0246 | 5.7200 |
| 0.1936 | 0.0346 | 5.7200 |
| 0.2014 | 0.0447 | 5.7200 |
| 0.2092 | 0.0548 | 5.7200 |
| 0.2168 | 0.0650 | 5.7200 |
| 0.2244 | 0.0753 | 5.7200 |
| 0.2319 | 0.0856 | 5.7200 |
| 0.2393 | 0.0960 | 5.7200 |
| 0.2466 | 0.1064 | 5.7200 |
| 0.2538 | 0.1169 | 5.7200 |
| 0.2610 | 0.1274 | 5.7200 |
| 0.2681 | 0.1380 | 5.7200 |
| 0.2751 | 0.1487 | 5.7200 |
| 0.2820 | 0.1594 | 5.7200 |
| 0.2888 | 0.1701 | 5.7200 |
| 0.2956 | 0.1809 | 5.7200 |
| 0.3022 | 0.1918 | 5.7200 |
| 0.3088 | 0.2027 | 5.7200 |
| 0.3153 | 0.2137 | 5.7200 |
| 0.3218 | 0.2247 | 5.7200 |
| 0.3281 | 0.2357 | 5.7200 |
| 0.3344 | 0.2468 | 5.7200 |
| 0.3406 | 0.2579 | 5.7200 |
| 0.3468 | 0.2691 | 5.7200 |
| 0.3528 | 0.2803 | 5.7200 |
| 0.3540 | 0.2825 | 5.7200 |
| 0.3552 | 0.2848 | 5.7200 |
| 0.3564 | 0.2870 | 5.7200 |
| 0.3576 | 0.2893 | 5.7200 |
| 0.3588 | 0.2915 | 5.7200 |
| 0.3600 | 0.2938 | 5.7200 |
| 0.3612 | 0.2960 | 5.7200 |
| 0.3624 | 0.2983 | 5.7200 |
| 0.3636 | 0.3005 | 5.7200 |
| 0.3647 | 0.3028 | 5.7200 |
| 0.3654 | 0.3044 | 5.7200 |
| 0.3658 | 0.3061 | 5.7200 |
| 0.3660 | 0.3078 | 5.7200 |
| 0.3659 | 0.3095 | 5.7200 |
| 0.3656 | 0.3112 | 5.7200 |
| 0.3650 | 0.3128 | 5.7200 |
| 0.3641 | 0.3143 | 5.7200 |
| 0.3631 | 0.3157 | 5.7200 |
| 0.3618 | 0.3169 | 5.7200 |
| 0.3604 | 0.3178 | 5.7200 |
| 0.3588 | 0.3186 | 5.7200 |
| 0.3572 | 0.3190 | 5.7200 |
| 0.3554 | 0.3191 | 5.7200 |

TABLE 2-continued

| X | Y | Z |
|---|---|---|
| 0.3537 | 0.3190 | 5.7200 |
| 0.3520 | 0.3186 | 5.7200 |
| 0.3505 | 0.3179 | 5.7200 |
| 0.3490 | 0.3169 | 5.7200 |
| 0.3478 | 0.3157 | 5.7200 |
| 0.3467 | 0.3143 | 5.7200 |
| 0.3454 | 0.3123 | 5.7200 |
| 0.3440 | 0.3102 | 5.7200 |
| 0.3427 | 0.3082 | 5.7200 |
| 0.3413 | 0.3061 | 5.7200 |
| 0.3400 | 0.3041 | 5.7200 |
| 0.3386 | 0.3021 | 5.7200 |
| 0.3372 | 0.3000 | 5.7200 |
| 0.3359 | 0.2980 | 5.7200 |
| 0.3345 | 0.2960 | 5.7200 |
| 0.3331 | 0.2939 | 5.7200 |
| 0.3261 | 0.2838 | 5.7200 |
| 0.3190 | 0.2738 | 5.7200 |
| 0.3118 | 0.2639 | 5.7200 |
| 0.3046 | 0.2540 | 5.7200 |
| 0.2972 | 0.2442 | 5.7200 |
| 0.2897 | 0.2345 | 5.7200 |
| 0.2822 | 0.2248 | 5.7200 |
| 0.2745 | 0.2152 | 5.7200 |
| 0.2668 | 0.2057 | 5.7200 |
| 0.2590 | 0.1962 | 5.7200 |
| 0.2512 | 0.1867 | 5.7200 |
| 0.2433 | 0.1774 | 5.7200 |
| 0.2353 | 0.1681 | 5.7200 |
| 0.2272 | 0.1588 | 5.7200 |
| 0.2191 | 0.1496 | 5.7200 |
| 0.2109 | 0.1405 | 5.7200 |
| 0.2027 | 0.1314 | 5.7200 |
| 0.1943 | 0.1224 | 5.7200 |
| 0.1860 | 0.1134 | 5.7200 |
| 0.1775 | 0.1045 | 5.7200 |
| 0.1690 | 0.0957 | 5.7200 |
| 0.1604 | 0.0869 | 5.7200 |
| 0.1518 | 0.0782 | 5.7200 |
| 0.1431 | 0.0695 | 5.7200 |
| 0.1343 | 0.0610 | 5.7200 |
| 0.1255 | 0.0525 | 5.7200 |
| 0.1166 | 0.0440 | 5.7200 |
| 0.1076 | 0.0357 | 5.7200 |
| 0.0986 | 0.0274 | 5.7200 |
| 0.0894 | 0.0191 | 5.7200 |
| 0.0803 | 0.0110 | 5.7200 |
| 0.0710 | 0.0029 | 5.7200 |
| 0.0617 | −0.0050 | 5.7200 |
| 0.0523 | −0.0130 | 5.7200 |
| 0.0429 | −0.0208 | 5.7200 |
| 0.0333 | −0.0286 | 5.7200 |
| 0.0238 | −0.0362 | 5.7200 |
| 0.0141 | −0.0438 | 5.7200 |
| 0.0044 | −0.0513 | 5.7200 |
| −0.0053 | −0.0587 | 5.7200 |
| −0.0151 | −0.0661 | 5.7200 |
| −0.0250 | −0.0734 | 5.7200 |
| −0.0349 | −0.0806 | 5.7200 |
| −0.0449 | −0.0878 | 5.7200 |
| −0.0549 | −0.0949 | 5.7200 |
| −0.0650 | −0.1019 | 5.7200 |
| −0.0751 | −0.1089 | 5.7200 |
| −0.0852 | −0.1158 | 5.7200 |
| −0.0953 | −0.1227 | 5.7200 |
| −0.1055 | −0.1295 | 5.7200 |
| −0.1158 | −0.1363 | 5.7200 |
| −0.1260 | −0.1430 | 5.7200 |
| −0.1363 | −0.1498 | 5.7200 |
| −0.1465 | −0.1565 | 5.7200 |
| −0.1568 | −0.1632 | 5.7200 |
| −0.1671 | −0.1699 | 5.7200 |
| −0.1774 | −0.1765 | 5.7200 |
| −0.1877 | −0.1832 | 5.7200 |
| −0.1980 | −0.1899 | 5.7200 |
| −0.2082 | −0.1966 | 5.7200 |
| −0.2185 | −0.2033 | 5.7200 |
| −0.2287 | −0.2101 | 5.7200 |

TABLE 2-continued

| X | Y | Z |
|---|---|---|
| −0.2390 | −0.2169 | 5.7200 |
| −0.2492 | −0.2237 | 5.7200 |
| −0.2593 | −0.2306 | 5.7200 |
| −0.2694 | −0.2376 | 5.7200 |
| −0.2795 | −0.2446 | 5.7200 |
| −0.2894 | −0.2517 | 5.7200 |
| −0.2994 | −0.2590 | 5.7200 |
| −0.3092 | −0.2663 | 5.7200 |
| −0.3190 | −0.2737 | 5.7200 |
| −0.3286 | −0.2813 | 5.7200 |
| −0.3381 | −0.2890 | 5.7200 |
| −0.3475 | −0.2969 | 5.7200 |
| −0.3568 | −0.3049 | 5.7200 |
| −0.3659 | −0.3132 | 5.7200 |
| −0.3749 | −0.3216 | 5.7200 |
| −0.3836 | −0.3302 | 5.7200 |
| −0.3921 | −0.3390 | 5.7200 |
| −0.3938 | −0.3408 | 5.7200 |
| −0.3955 | −0.3426 | 5.7200 |
| −0.3971 | −0.3444 | 5.7200 |
| −0.3988 | −0.3462 | 5.7200 |
| −0.4004 | −0.3481 | 5.7200 |
| −0.4020 | −0.3499 | 5.7200 |
| −0.4036 | −0.3517 | 5.7200 |
| −0.4053 | −0.3536 | 5.7200 |
| −0.4068 | −0.3555 | 5.7200 |
| −0.4084 | −0.3573 | 5.7200 |
| −0.4104 | −0.3598 | 5.7200 |
| −0.4122 | −0.3625 | 5.7200 |
| −0.4138 | −0.3652 | 5.7200 |
| −0.4151 | −0.3681 | 5.7200 |
| −0.4162 | −0.3711 | 5.7200 |
| −0.4170 | −0.3742 | 5.7200 |
| −0.4173 | −0.3773 | 5.7200 |
| −0.4172 | −0.3805 | 5.7200 |
| −0.4166 | −0.3836 | 5.7200 |
| −0.4154 | −0.3865 | 5.7200 |
| −0.4135 | −0.3892 | 5.7200 |
| −0.4112 | −0.3914 | 5.7200 |
| −0.4086 | −0.3931 | 5.7200 |
| −0.4057 | −0.3943 | 5.7200 |
| −0.4026 | −0.3951 | 5.7200 |
| −0.3994 | −0.3955 | 5.7200 |
| −0.3963 | −0.3956 | 5.7200 |
| −0.3931 | −0.3954 | 5.7200 |
| | SECTION 7 | |
| −0.4326 | −0.4221 | 5.9300 |
| −0.4299 | −0.4220 | 5.9300 |
| −0.4272 | −0.4219 | 5.9300 |
| −0.4245 | −0.4217 | 5.9300 |
| −0.4218 | −0.4215 | 5.9300 |
| −0.4191 | −0.4213 | 5.9300 |
| −0.4164 | −0.4210 | 5.9300 |
| −0.4137 | −0.4208 | 5.9300 |
| −0.4110 | −0.4205 | 5.9300 |
| −0.4083 | −0.4202 | 5.9300 |
| −0.4056 | −0.4198 | 5.9300 |
| −0.3922 | −0.4177 | 5.9300 |
| −0.3789 | −0.4151 | 5.9300 |
| −0.3657 | −0.4120 | 5.9300 |
| −0.3527 | −0.4084 | 5.9300 |
| −0.3397 | −0.4045 | 5.9300 |
| −0.3268 | −0.4002 | 5.9300 |
| −0.3141 | −0.3955 | 5.9300 |
| −0.3015 | −0.3906 | 5.9300 |
| −0.2890 | −0.3853 | 5.9300 |
| −0.2766 | −0.3798 | 5.9300 |
| −0.2644 | −0.3741 | 5.9300 |
| −0.2522 | −0.3681 | 5.9300 |
| −0.2402 | −0.3619 | 5.9300 |
| −0.2282 | −0.3554 | 5.9300 |
| −0.2164 | −0.3488 | 5.9300 |
| −0.2047 | −0.3420 | 5.9300 |
| −0.1932 | −0.3349 | 5.9300 |
| −0.1817 | −0.3277 | 5.9300 |
| −0.1703 | −0.3203 | 5.9300 |
| −0.1591 | −0.3127 | 5.9300 |

TABLE 2-continued

| X | Y | Z |
|---|---|---|
| −0.1480 | −0.3050 | 5.9300 |
| −0.1370 | −0.2971 | 5.9300 |
| −0.1261 | −0.2891 | 5.9300 |
| −0.1153 | −0.2809 | 5.9300 |
| −0.1046 | −0.2725 | 5.9300 |
| −0.0940 | −0.2641 | 5.9300 |
| −0.0835 | −0.2555 | 5.9300 |
| −0.0731 | −0.2468 | 5.9300 |
| −0.0628 | −0.2380 | 5.9300 |
| −0.0526 | −0.2291 | 5.9300 |
| −0.0425 | −0.2200 | 5.9300 |
| −0.0325 | −0.2109 | 5.9300 |
| −0.0226 | −0.2016 | 5.9300 |
| −0.0128 | −0.1923 | 5.9300 |
| −0.0030 | −0.1829 | 5.9300 |
| 0.0066 | −0.1734 | 5.9300 |
| 0.0162 | −0.1638 | 5.9300 |
| 0.0257 | −0.1542 | 5.9300 |
| 0.0352 | −0.1445 | 5.9300 |
| 0.0445 | −0.1347 | 5.9300 |
| 0.0538 | −0.1248 | 5.9300 |
| 0.0630 | −0.1149 | 5.9300 |
| 0.0722 | −0.1049 | 5.9300 |
| 0.0813 | −0.0948 | 5.9300 |
| 0.0903 | −0.0847 | 5.9300 |
| 0.0992 | −0.0745 | 5.9300 |
| 0.1080 | −0.0642 | 5.9300 |
| 0.1168 | −0.0539 | 5.9300 |
| 0.1255 | −0.0435 | 5.9300 |
| 0.1342 | −0.0331 | 5.9300 |
| 0.1427 | −0.0226 | 5.9300 |
| 0.1512 | −0.0120 | 5.9300 |
| 0.1596 | −0.0014 | 5.9300 |
| 0.1679 | 0.0093 | 5.9300 |
| 0.1762 | 0.0200 | 5.9300 |
| 0.1844 | 0.0309 | 5.9300 |
| 0.1925 | 0.0417 | 5.9300 |
| 0.2005 | 0.0526 | 5.9300 |
| 0.2084 | 0.0636 | 5.9300 |
| 0.2163 | 0.0747 | 5.9300 |
| 0.2240 | 0.0858 | 5.9300 |
| 0.2317 | 0.0969 | 5.9300 |
| 0.2393 | 0.1082 | 5.9300 |
| 0.2468 | 0.1194 | 5.9300 |
| 0.2543 | 0.1308 | 5.9300 |
| 0.2616 | 0.1421 | 5.9300 |
| 0.2689 | 0.1536 | 5.9300 |
| 0.2760 | 0.1651 | 5.9300 |
| 0.2831 | 0.1766 | 5.9300 |
| 0.2901 | 0.1882 | 5.9300 |
| 0.2971 | 0.1999 | 5.9300 |
| 0.3039 | 0.2116 | 5.9300 |
| 0.3107 | 0.2233 | 5.9300 |
| 0.3173 | 0.2351 | 5.9300 |
| 0.3239 | 0.2469 | 5.9300 |
| 0.3305 | 0.2588 | 5.9300 |
| 0.3369 | 0.2707 | 5.9300 |
| 0.3433 | 0.2827 | 5.9300 |
| 0.3495 | 0.2947 | 5.9300 |
| 0.3508 | 0.2971 | 5.9300 |
| 0.3520 | 0.2995 | 5.9300 |
| 0.3533 | 0.3019 | 5.9300 |
| 0.3545 | 0.3043 | 5.9300 |
| 0.3558 | 0.3068 | 5.9300 |
| 0.3570 | 0.3092 | 5.9300 |
| 0.3582 | 0.3116 | 5.9300 |
| 0.3594 | 0.3140 | 5.9300 |
| 0.3607 | 0.3164 | 5.9300 |
| 0.3619 | 0.3188 | 5.9300 |
| 0.3625 | 0.3204 | 5.9300 |
| 0.3629 | 0.3221 | 5.9300 |
| 0.3631 | 0.3238 | 5.9300 |
| 0.3630 | 0.3255 | 5.9300 |
| 0.3626 | 0.3272 | 5.9300 |
| 0.3620 | 0.3288 | 5.9300 |
| 0.3611 | 0.3303 | 5.9300 |
| 0.3601 | 0.3317 | 5.9300 |
| 0.3588 | 0.3328 | 5.9300 |

TABLE 2-continued

| X | Y | Z |
|---|---|---|
| 0.3573 | 0.3338 | 5.9300 |
| 0.3558 | 0.3344 | 5.9300 |
| 0.3541 | 0.3349 | 5.9300 |
| 0.3524 | 0.3350 | 5.9300 |
| 0.3507 | 0.3348 | 5.9300 |
| 0.3490 | 0.3344 | 5.9300 |
| 0.3475 | 0.3337 | 5.9300 |
| 0.3460 | 0.3327 | 5.9300 |
| 0.3448 | 0.3315 | 5.9300 |
| 0.3438 | 0.3301 | 5.9300 |
| 0.3424 | 0.3279 | 5.9300 |
| 0.3410 | 0.3257 | 5.9300 |
| 0.3396 | 0.3236 | 5.9300 |
| 0.3382 | 0.3214 | 5.9300 |
| 0.3368 | 0.3192 | 5.9300 |
| 0.3354 | 0.3170 | 5.9300 |
| 0.3340 | 0.3149 | 5.9300 |
| 0.3325 | 0.3126 | 5.9300 |
| 0.3311 | 0.3105 | 5.9300 |
| 0.3297 | 0.3084 | 5.9300 |
| 0.3226 | 0.2976 | 5.9300 |
| 0.3153 | 0.2869 | 5.9300 |
| 0.3080 | 0.2762 | 5.9300 |
| 0.3006 | 0.2656 | 5.9300 |
| 0.2931 | 0.2550 | 5.9300 |
| 0.2855 | 0.2446 | 5.9300 |
| 0.2778 | 0.2341 | 5.9300 |
| 0.2701 | 0.2238 | 5.9300 |
| 0.2622 | 0.2135 | 5.9300 |
| 0.2543 | 0.2032 | 5.9300 |
| 0.2463 | 0.1930 | 5.9300 |
| 0.2383 | 0.1829 | 5.9300 |
| 0.2302 | 0.1728 | 5.9300 |
| 0.2220 | 0.1628 | 5.9300 |
| 0.2137 | 0.1529 | 5.9300 |
| 0.2054 | 0.1430 | 5.9300 |
| 0.1970 | 0.1331 | 5.9300 |
| 0.1885 | 0.1233 | 5.9300 |
| 0.1799 | 0.1136 | 5.9300 |
| 0.1713 | 0.1040 | 5.9300 |
| 0.1626 | 0.0944 | 5.9300 |
| 0.1538 | 0.0849 | 5.9300 |
| 0.1450 | 0.0755 | 5.9300 |
| 0.1360 | 0.0661 | 5.9300 |
| 0.1270 | 0.0568 | 5.9300 |
| 0.1179 | 0.0476 | 5.9300 |
| 0.1088 | 0.0384 | 5.9300 |
| 0.0995 | 0.0294 | 5.9300 |
| 0.0902 | 0.0204 | 5.9300 |
| 0.0808 | 0.0115 | 5.9300 |
| 0.0714 | 0.0027 | 5.9300 |
| 0.0618 | −0.0060 | 5.9300 |
| 0.0522 | −0.0147 | 5.9300 |
| 0.0425 | −0.0233 | 5.9300 |
| 0.0327 | −0.0317 | 5.9300 |
| 0.0228 | −0.0401 | 5.9300 |
| 0.0129 | −0.0484 | 5.9300 |
| 0.0029 | −0.0566 | 5.9300 |
| −0.0072 | −0.0648 | 5.9300 |
| −0.0173 | −0.0728 | 5.9300 |
| −0.0275 | −0.0808 | 5.9300 |
| −0.0378 | −0.0886 | 5.9300 |
| −0.0481 | −0.0964 | 5.9300 |
| −0.0585 | −0.1041 | 5.9300 |
| −0.0689 | −0.1118 | 5.9300 |
| −0.0794 | −0.1194 | 5.9300 |
| −0.0900 | −0.1269 | 5.9300 |
| −0.1006 | −0.1343 | 5.9300 |
| −0.1112 | −0.1417 | 5.9300 |
| −0.1218 | −0.1491 | 5.9300 |
| −0.1325 | −0.1564 | 5.9300 |
| −0.1432 | −0.1636 | 5.9300 |
| −0.1540 | −0.1708 | 5.9300 |
| −0.1647 | −0.1780 | 5.9300 |
| −0.1755 | −0.1852 | 5.9300 |
| −0.1863 | −0.1923 | 5.9300 |
| −0.1972 | −0.1994 | 5.9300 |
| −0.2080 | −0.2065 | 5.9300 |

TABLE 2-continued

| X | Y | Z |
|---|---|---|
| −0.2188 | −0.2135 | 5.9300 |
| −0.2297 | −0.2206 | 5.9300 |
| −0.2405 | −0.2277 | 5.9300 |
| −0.2514 | −0.2347 | 5.9300 |
| −0.2622 | −0.2418 | 5.9300 |
| −0.2730 | −0.2489 | 5.9300 |
| −0.2838 | −0.2561 | 5.9300 |
| −0.2945 | −0.2633 | 5.9300 |
| −0.3053 | −0.2705 | 5.9300 |
| −0.3159 | −0.2779 | 5.9300 |
| −0.3265 | −0.2853 | 5.9300 |
| −0.3371 | −0.2927 | 5.9300 |
| −0.3476 | −0.3003 | 5.9300 |
| −0.3580 | −0.3080 | 5.9300 |
| −0.3683 | −0.3158 | 5.9300 |
| −0.3785 | −0.3238 | 5.9300 |
| −0.3886 | −0.3318 | 5.9300 |
| −0.3987 | −0.3400 | 5.9300 |
| −0.4085 | −0.3484 | 5.9300 |
| −0.4183 | −0.3569 | 5.9300 |
| −0.4279 | −0.3656 | 5.9300 |
| −0.4298 | −0.3673 | 5.9300 |
| −0.4317 | −0.3691 | 5.9300 |
| −0.4336 | −0.3709 | 5.9300 |
| −0.4355 | −0.3727 | 5.9300 |
| −0.4373 | −0.3744 | 5.9300 |
| −0.4392 | −0.3762 | 5.9300 |
| −0.4411 | −0.3780 | 5.9300 |
| −0.4429 | −0.3798 | 5.9300 |
| −0.4448 | −0.3817 | 5.9300 |
| −0.4466 | −0.3835 | 5.9300 |
| −0.4487 | −0.3857 | 5.9300 |
| −0.4506 | −0.3881 | 5.9300 |
| −0.4523 | −0.3906 | 5.9300 |
| −0.4538 | −0.3932 | 5.9300 |
| −0.4551 | −0.3960 | 5.9300 |
| −0.4561 | −0.3989 | 5.9300 |
| −0.4567 | −0.4019 | 5.9300 |
| −0.4569 | −0.4049 | 5.9300 |
| −0.4566 | −0.4079 | 5.9300 |
| −0.4557 | −0.4108 | 5.9300 |
| −0.4543 | −0.4135 | 5.9300 |
| −0.4524 | −0.4159 | 5.9300 |
| −0.4501 | −0.4179 | 5.9300 |
| −0.4474 | −0.4194 | 5.9300 |
| −0.4446 | −0.4206 | 5.9300 |
| −0.4417 | −0.4214 | 5.9300 |
| −0.4387 | −0.4219 | 5.9300 |
| −0.4356 | −0.4221 | 5.9300 |
| SECTION 8 | | |
| −0.4815 | −0.4448 | 6.1400 |
| −0.4786 | −0.4452 | 6.1400 |
| −0.4758 | −0.4455 | 6.1400 |
| −0.4729 | −0.4458 | 6.1400 |
| −0.4700 | −0.4461 | 6.1400 |
| −0.4672 | −0.4463 | 6.1400 |
| −0.4643 | −0.4465 | 6.1400 |
| −0.4614 | −0.4467 | 6.1400 |
| −0.4586 | −0.4468 | 6.1400 |
| −0.4557 | −0.4469 | 6.1400 |
| −0.4528 | −0.4469 | 6.1400 |
| −0.4384 | −0.4465 | 6.1400 |
| −0.4241 | −0.4453 | 6.1400 |
| −0.4098 | −0.4433 | 6.1400 |
| −0.3957 | −0.4406 | 6.1400 |
| −0.3817 | −0.4374 | 6.1400 |
| −0.3678 | −0.4336 | 6.1400 |
| −0.3541 | −0.4293 | 6.1400 |
| −0.3405 | −0.4246 | 6.1400 |
| −0.3270 | −0.4194 | 6.1400 |
| −0.3137 | −0.4139 | 6.1400 |
| −0.3006 | −0.4081 | 6.1400 |
| −0.2876 | −0.4020 | 6.1400 |
| −0.2747 | −0.3955 | 6.1400 |
| −0.2620 | −0.3888 | 6.1400 |
| −0.2494 | −0.3819 | 6.1400 |
| −0.2370 | −0.3747 | 6.1400 |

TABLE 2-continued

| X | Y | Z |
|---|---|---|
| −0.2246 | −0.3672 | 6.1400 |
| −0.2125 | −0.3596 | 6.1400 |
| −0.2004 | −0.3517 | 6.1400 |
| −0.1885 | −0.3436 | 6.1400 |
| −0.1767 | −0.3354 | 6.1400 |
| −0.1651 | −0.3269 | 6.1400 |
| −0.1535 | −0.3183 | 6.1400 |
| −0.1422 | −0.3095 | 6.1400 |
| −0.1309 | −0.3006 | 6.1400 |
| −0.1197 | −0.2915 | 6.1400 |
| −0.1087 | −0.2822 | 6.1400 |
| −0.0978 | −0.2729 | 6.1400 |
| −0.0870 | −0.2633 | 6.1400 |
| −0.0763 | −0.2537 | 6.1400 |
| −0.0658 | −0.2439 | 6.1400 |
| −0.0553 | −0.2341 | 6.1400 |
| −0.0450 | −0.2241 | 6.1400 |
| −0.0347 | −0.2140 | 6.1400 |
| −0.0245 | −0.2038 | 6.1400 |
| −0.0145 | −0.1935 | 6.1400 |
| −0.0045 | −0.1831 | 6.1400 |
| 0.0054 | −0.1727 | 6.1400 |
| 0.0152 | −0.1621 | 6.1400 |
| 0.0249 | −0.1515 | 6.1400 |
| 0.0345 | −0.1409 | 6.1400 |
| 0.0441 | −0.1301 | 6.1400 |
| 0.0536 | −0.1193 | 6.1400 |
| 0.0630 | −0.1084 | 6.1400 |
| 0.0724 | −0.0975 | 6.1400 |
| 0.0817 | −0.0865 | 6.1400 |
| 0.0909 | −0.0755 | 6.1400 |
| 0.1001 | −0.0644 | 6.1400 |
| 0.1092 | −0.0533 | 6.1400 |
| 0.1182 | −0.0421 | 6.1400 |
| 0.1272 | −0.0308 | 6.1400 |
| 0.1361 | −0.0195 | 6.1400 |
| 0.1449 | −0.0081 | 6.1400 |
| 0.1536 | 0.0033 | 6.1400 |
| 0.1623 | 0.0148 | 6.1400 |
| 0.1708 | 0.0264 | 6.1400 |
| 0.1793 | 0.0380 | 6.1400 |
| 0.1877 | 0.0497 | 6.1400 |
| 0.1960 | 0.0614 | 6.1400 |
| 0.2042 | 0.0732 | 6.1400 |
| 0.2123 | 0.0851 | 6.1400 |
| 0.2203 | 0.0971 | 6.1400 |
| 0.2283 | 0.1091 | 6.1400 |
| 0.2361 | 0.1211 | 6.1400 |
| 0.2439 | 0.1332 | 6.1400 |
| 0.2515 | 0.1454 | 6.1400 |
| 0.2591 | 0.1577 | 6.1400 |
| 0.2665 | 0.1700 | 6.1400 |
| 0.2739 | 0.1823 | 6.1400 |
| 0.2812 | 0.1947 | 6.1400 |
| 0.2884 | 0.2072 | 6.1400 |
| 0.2955 | 0.2197 | 6.1400 |
| 0.3025 | 0.2323 | 6.1400 |
| 0.3094 | 0.2449 | 6.1400 |
| 0.3162 | 0.2576 | 6.1400 |
| 0.3229 | 0.2703 | 6.1400 |
| 0.3295 | 0.2831 | 6.1400 |
| 0.3361 | 0.2959 | 6.1400 |
| 0.3426 | 0.3087 | 6.1400 |
| 0.3438 | 0.3113 | 6.1400 |
| 0.3451 | 0.3139 | 6.1400 |
| 0.3464 | 0.3165 | 6.1400 |
| 0.3477 | 0.3190 | 6.1400 |
| 0.3489 | 0.3216 | 6.1400 |
| 0.3502 | 0.3242 | 6.1400 |
| 0.3514 | 0.3268 | 6.1400 |
| 0.3527 | 0.3294 | 6.1400 |
| 0.3540 | 0.3320 | 6.1400 |
| 0.3552 | 0.3346 | 6.1400 |
| 0.3558 | 0.3362 | 6.1400 |
| 0.3562 | 0.3378 | 6.1400 |
| 0.3563 | 0.3396 | 6.1400 |
| 0.3562 | 0.3413 | 6.1400 |
| 0.3558 | 0.3429 | 6.1400 |

TABLE 2-continued

| X | Y | Z |
|---|---|---|
| 0.3552 | 0.3445 | 6.1400 |
| 0.3543 | 0.3460 | 6.1400 |
| 0.3532 | 0.3473 | 6.1400 |
| 0.3519 | 0.3485 | 6.1400 |
| 0.3505 | 0.3494 | 6.1400 |
| 0.3489 | 0.3501 | 6.1400 |
| 0.3472 | 0.3505 | 6.1400 |
| 0.3455 | 0.3506 | 6.1400 |
| 0.3438 | 0.3504 | 6.1400 |
| 0.3422 | 0.3500 | 6.1400 |
| 0.3406 | 0.3492 | 6.1400 |
| 0.3392 | 0.3482 | 6.1400 |
| 0.3380 | 0.3470 | 6.1400 |
| 0.3370 | 0.3456 | 6.1400 |
| 0.3356 | 0.3433 | 6.1400 |
| 0.3341 | 0.3410 | 6.1400 |
| 0.3327 | 0.3387 | 6.1400 |
| 0.3312 | 0.3364 | 6.1400 |
| 0.3298 | 0.3341 | 6.1400 |
| 0.3284 | 0.3318 | 6.1400 |
| 0.3269 | 0.3295 | 6.1400 |
| 0.3254 | 0.3271 | 6.1400 |
| 0.3240 | 0.3249 | 6.1400 |
| 0.3225 | 0.3226 | 6.1400 |
| 0.3152 | 0.3112 | 6.1400 |
| 0.3078 | 0.2998 | 6.1400 |
| 0.3003 | 0.2884 | 6.1400 |
| 0.2927 | 0.2771 | 6.1400 |
| 0.2851 | 0.2659 | 6.1400 |
| 0.2774 | 0.2547 | 6.1400 |
| 0.2696 | 0.2436 | 6.1400 |
| 0.2617 | 0.2325 | 6.1400 |
| 0.2538 | 0.2215 | 6.1400 |
| 0.2457 | 0.2105 | 6.1400 |
| 0.2376 | 0.1996 | 6.1400 |
| 0.2295 | 0.1887 | 6.1400 |
| 0.2212 | 0.1779 | 6.1400 |
| 0.2129 | 0.1672 | 6.1400 |
| 0.2045 | 0.1565 | 6.1400 |
| 0.1960 | 0.1459 | 6.1400 |
| 0.1874 | 0.1353 | 6.1400 |
| 0.1788 | 0.1249 | 6.1400 |
| 0.1701 | 0.1144 | 6.1400 |
| 0.1613 | 0.1041 | 6.1400 |
| 0.1524 | 0.0938 | 6.1400 |
| 0.1434 | 0.0836 | 6.1400 |
| 0.1344 | 0.0734 | 6.1400 |
| 0.1252 | 0.0634 | 6.1400 |
| 0.1160 | 0.0534 | 6.1400 |
| 0.1067 | 0.0435 | 6.1400 |
| 0.0973 | 0.0336 | 6.1400 |
| 0.0879 | 0.0239 | 6.1400 |
| 0.0783 | 0.0142 | 6.1400 |
| 0.0687 | 0.0046 | 6.1400 |
| 0.0590 | −0.0049 | 6.1400 |
| 0.0492 | −0.0143 | 6.1400 |
| 0.0393 | −0.0236 | 6.1400 |
| 0.0293 | −0.0329 | 6.1400 |
| 0.0193 | −0.0420 | 6.1400 |
| 0.0092 | −0.0511 | 6.1400 |
| −0.0010 | −0.0601 | 6.1400 |
| −0.0113 | −0.0690 | 6.1400 |
| −0.0217 | −0.0778 | 6.1400 |
| −0.0321 | −0.0865 | 6.1400 |
| −0.0426 | −0.0951 | 6.1400 |
| −0.0532 | −0.1036 | 6.1400 |
| −0.0639 | −0.1121 | 6.1400 |
| −0.0746 | −0.1204 | 6.1400 |
| −0.0854 | −0.1286 | 6.1400 |
| −0.0962 | −0.1368 | 6.1400 |
| −0.1072 | −0.1449 | 6.1400 |
| −0.1181 | −0.1530 | 6.1400 |
| −0.1292 | −0.1609 | 6.1400 |
| −0.1402 | −0.1688 | 6.1400 |
| −0.1513 | −0.1766 | 6.1400 |
| −0.1625 | −0.1844 | 6.1400 |
| −0.1737 | −0.1921 | 6.1400 |
| −0.1849 | −0.1997 | 6.1400 |

TABLE 2-continued

| X | Y | Z |
|---|---|---|
| −0.1962 | −0.2073 | 6.1400 |
| −0.2075 | −0.2148 | 6.1400 |
| −0.2189 | −0.2223 | 6.1400 |
| −0.2302 | −0.2298 | 6.1400 |
| −0.2416 | −0.2372 | 6.1400 |
| −0.2530 | −0.2446 | 6.1400 |
| −0.2644 | −0.2520 | 6.1400 |
| −0.2759 | −0.2593 | 6.1400 |
| −0.2873 | −0.2667 | 6.1400 |
| −0.2988 | −0.2740 | 6.1400 |
| −0.3102 | −0.2813 | 6.1400 |
| −0.3216 | −0.2887 | 6.1400 |
| −0.3330 | −0.2960 | 6.1400 |
| −0.3444 | −0.3034 | 6.1400 |
| −0.3558 | −0.3109 | 6.1400 |
| −0.3672 | −0.3184 | 6.1400 |
| −0.3785 | −0.3259 | 6.1400 |
| −0.3898 | −0.3334 | 6.1400 |
| −0.4010 | −0.3411 | 6.1400 |
| −0.4122 | −0.3488 | 6.1400 |
| −0.4234 | −0.3565 | 6.1400 |
| −0.4345 | −0.3643 | 6.1400 |
| −0.4456 | −0.3722 | 6.1400 |
| −0.4566 | −0.3801 | 6.1400 |
| −0.4676 | −0.3882 | 6.1400 |
| −0.4698 | −0.3898 | 6.1400 |
| −0.4720 | −0.3914 | 6.1400 |
| −0.4742 | −0.3930 | 6.1400 |
| −0.4763 | −0.3947 | 6.1400 |
| −0.4785 | −0.3963 | 6.1400 |
| −0.4807 | −0.3979 | 6.1400 |
| −0.4829 | −0.3995 | 6.1400 |
| −0.4850 | −0.4012 | 6.1400 |
| −0.4872 | −0.4028 | 6.1400 |
| −0.4893 | −0.4045 | 6.1400 |
| −0.4916 | −0.4064 | 6.1400 |
| −0.4938 | −0.4084 | 6.1400 |
| −0.4958 | −0.4106 | 6.1400 |
| −0.4977 | −0.4130 | 6.1400 |
| −0.4993 | −0.4155 | 6.1400 |
| −0.5006 | −0.4182 | 6.1400 |
| −0.5016 | −0.4210 | 6.1400 |
| −0.5022 | −0.4239 | 6.1400 |
| −0.5023 | −0.4269 | 6.1400 |
| −0.5018 | −0.4298 | 6.1400 |
| −0.5009 | −0.4326 | 6.1400 |
| −0.4994 | −0.4352 | 6.1400 |
| −0.4975 | −0.4375 | 6.1400 |
| −0.4952 | −0.4395 | 6.1400 |
| −0.4927 | −0.4411 | 6.1400 |
| −0.4901 | −0.4424 | 6.1400 |
| −0.4873 | −0.4435 | 6.1400 |
| −0.4844 | −0.4443 | 6.1400 |
| | SECTION 9 | |
| −0.5348 | −0.4642 | 6.3500 |
| −0.5320 | −0.4652 | 6.3500 |
| −0.5290 | −0.4662 | 6.3500 |
| −0.5261 | −0.4671 | 6.3500 |
| −0.5232 | −0.4679 | 6.3500 |
| −0.5202 | −0.4686 | 6.3500 |
| −0.5172 | −0.4693 | 6.3500 |
| −0.5142 | −0.4700 | 6.3500 |
| −0.5113 | −0.4706 | 6.3500 |
| −0.5083 | −0.4711 | 6.3500 |
| −0.5053 | −0.4716 | 6.3500 |
| −0.4901 | −0.4735 | 6.3500 |
| −0.4749 | −0.4742 | 6.3500 |
| −0.4597 | −0.4739 | 6.3500 |
| −0.4444 | −0.4726 | 6.3500 |
| −0.4293 | −0.4705 | 6.3500 |
| −0.4144 | −0.4677 | 6.3500 |
| −0.3995 | −0.4641 | 6.3500 |
| −0.3848 | −0.4600 | 6.3500 |
| −0.3704 | −0.4552 | 6.3500 |
| −0.3560 | −0.4499 | 6.3500 |
| −0.3419 | −0.4442 | 6.3500 |
| −0.3280 | −0.4380 | 6.3500 |

TABLE 2-continued

| X | Y | Z |
|---|---|---|
| −0.3142 | −0.4314 | 6.3500 |
| −0.3006 | −0.4245 | 6.3500 |
| −0.2872 | −0.4172 | 6.3500 |
| −0.2740 | −0.4096 | 6.3500 |
| −0.2609 | −0.4017 | 6.3500 |
| −0.2480 | −0.3936 | 6.3500 |
| −0.2353 | −0.3852 | 6.3500 |
| −0.2227 | −0.3765 | 6.3500 |
| −0.2103 | −0.3677 | 6.3500 |
| −0.1981 | −0.3586 | 6.3500 |
| −0.1860 | −0.3493 | 6.3500 |
| −0.1740 | −0.3398 | 6.3500 |
| −0.1622 | −0.3301 | 6.3500 |
| −0.1505 | −0.3203 | 6.3500 |
| −0.1390 | −0.3103 | 6.3500 |
| −0.1276 | −0.3002 | 6.3500 |
| −0.1164 | −0.2899 | 6.3500 |
| −0.1053 | −0.2794 | 6.3500 |
| −0.0943 | −0.2689 | 6.3500 |
| −0.0834 | −0.2582 | 6.3500 |
| −0.0726 | −0.2474 | 6.3500 |
| −0.0619 | −0.2364 | 6.3500 |
| −0.0514 | −0.2254 | 6.3500 |
| −0.0409 | −0.2143 | 6.3500 |
| −0.0306 | −0.2031 | 6.3500 |
| −0.0203 | −0.1918 | 6.3500 |
| −0.0101 | −0.1805 | 6.3500 |
| 0.0000 | −0.1690 | 6.3500 |
| 0.0100 | −0.1575 | 6.3500 |
| 0.0199 | −0.1460 | 6.3500 |
| 0.0298 | −0.1344 | 6.3500 |
| 0.0396 | −0.1227 | 6.3500 |
| 0.0494 | −0.1110 | 6.3500 |
| 0.0591 | −0.0992 | 6.3500 |
| 0.0688 | −0.0874 | 6.3500 |
| 0.0784 | −0.0756 | 6.3500 |
| 0.0879 | −0.0636 | 6.3500 |
| 0.0974 | −0.0517 | 6.3500 |
| 0.1068 | −0.0397 | 6.3500 |
| 0.1161 | −0.0276 | 6.3500 |
| 0.1254 | −0.0155 | 6.3500 |
| 0.1346 | −0.0033 | 6.3500 |
| 0.1437 | 0.0089 | 6.3500 |
| 0.1527 | 0.0212 | 6.3500 |
| 0.1616 | 0.0336 | 6.3500 |
| 0.1705 | 0.0460 | 6.3500 |
| 0.1792 | 0.0586 | 6.3500 |
| 0.1878 | 0.0711 | 6.3500 |
| 0.1964 | 0.0838 | 6.3500 |
| 0.2048 | 0.0965 | 6.3500 |
| 0.2132 | 0.1092 | 6.3500 |
| 0.2214 | 0.1221 | 6.3500 |
| 0.2295 | 0.1350 | 6.3500 |
| 0.2375 | 0.1480 | 6.3500 |
| 0.2454 | 0.1610 | 6.3500 |
| 0.2532 | 0.1741 | 6.3500 |
| 0.2609 | 0.1873 | 6.3500 |
| 0.2685 | 0.2005 | 6.3500 |
| 0.2760 | 0.2138 | 6.3500 |
| 0.2834 | 0.2272 | 6.3500 |
| 0.2906 | 0.2406 | 6.3500 |
| 0.2978 | 0.2541 | 6.3500 |
| 0.3048 | 0.2676 | 6.3500 |
| 0.3117 | 0.2812 | 6.3500 |
| 0.3186 | 0.2949 | 6.3500 |
| 0.3253 | 0.3086 | 6.3500 |
| 0.3318 | 0.3223 | 6.3500 |
| 0.3331 | 0.3251 | 6.3500 |
| 0.3344 | 0.3278 | 6.3500 |
| 0.3357 | 0.3306 | 6.3500 |
| 0.3370 | 0.3334 | 6.3500 |
| 0.3383 | 0.3361 | 6.3500 |
| 0.3396 | 0.3389 | 6.3500 |
| 0.3409 | 0.3417 | 6.3500 |
| 0.3421 | 0.3444 | 6.3500 |
| 0.3434 | 0.3472 | 6.3500 |
| 0.3447 | 0.3500 | 6.3500 |
| 0.3452 | 0.3516 | 6.3500 |

TABLE 2-continued

| X | Y | Z |
|---|---|---|
| 0.3456 | 0.3533 | 6.3500 |
| 0.3457 | 0.3550 | 6.3500 |
| 0.3455 | 0.3567 | 6.3500 |
| 0.3451 | 0.3584 | 6.3500 |
| 0.3445 | 0.3599 | 6.3500 |
| 0.3436 | 0.3614 | 6.3500 |
| 0.3425 | 0.3627 | 6.3500 |
| 0.3413 | 0.3639 | 6.3500 |
| 0.3398 | 0.3648 | 6.3500 |
| 0.3382 | 0.3655 | 6.3500 |
| 0.3366 | 0.3659 | 6.3500 |
| 0.3349 | 0.3660 | 6.3500 |
| 0.3332 | 0.3658 | 6.3500 |
| 0.3315 | 0.3653 | 6.3500 |
| 0.3300 | 0.3645 | 6.3500 |
| 0.3286 | 0.3635 | 6.3500 |
| 0.3274 | 0.3623 | 6.3500 |
| 0.3264 | 0.3609 | 6.3500 |
| 0.3250 | 0.3585 | 6.3500 |
| 0.3235 | 0.3561 | 6.3500 |
| 0.3220 | 0.3537 | 6.3500 |
| 0.3205 | 0.3512 | 6.3500 |
| 0.3190 | 0.3488 | 6.3500 |
| 0.3175 | 0.3463 | 6.3500 |
| 0.3160 | 0.3439 | 6.3500 |
| 0.3145 | 0.3415 | 6.3500 |
| 0.3130 | 0.3391 | 6.3500 |
| 0.3115 | 0.3367 | 6.3500 |
| 0.3040 | 0.3246 | 6.3500 |
| 0.2964 | 0.3126 | 6.3500 |
| 0.2888 | 0.3006 | 6.3500 |
| 0.2810 | 0.2886 | 6.3500 |
| 0.2733 | 0.2767 | 6.3500 |
| 0.2654 | 0.2649 | 6.3500 |
| 0.2575 | 0.2530 | 6.3500 |
| 0.2495 | 0.2413 | 6.3500 |
| 0.2414 | 0.2295 | 6.3500 |
| 0.2333 | 0.2179 | 6.3500 |
| 0.2251 | 0.2063 | 6.3500 |
| 0.2168 | 0.1947 | 6.3500 |
| 0.2084 | 0.1832 | 6.3500 |
| 0.2000 | 0.1717 | 6.3500 |
| 0.1914 | 0.1603 | 6.3500 |
| 0.1828 | 0.1490 | 6.3500 |
| 0.1742 | 0.1377 | 6.3500 |
| 0.1654 | 0.1265 | 6.3500 |
| 0.1565 | 0.1154 | 6.3500 |
| 0.1476 | 0.1044 | 6.3500 |
| 0.1385 | 0.0934 | 6.3500 |
| 0.1294 | 0.0824 | 6.3500 |
| 0.1202 | 0.0716 | 6.3500 |
| 0.1109 | 0.0608 | 6.3500 |
| 0.1015 | 0.0501 | 6.3500 |
| 0.0920 | 0.0395 | 6.3500 |
| 0.0825 | 0.0290 | 6.3500 |
| 0.0728 | 0.0186 | 6.3500 |
| 0.0630 | 0.0082 | 6.3500 |
| 0.0532 | −0.0021 | 6.3500 |
| 0.0433 | −0.0123 | 6.3500 |
| 0.0332 | −0.0224 | 6.3500 |
| 0.0231 | −0.0324 | 6.3500 |
| 0.0129 | −0.0423 | 6.3500 |
| 0.0026 | −0.0521 | 6.3500 |
| −0.0077 | −0.0619 | 6.3500 |
| −0.0182 | −0.0715 | 6.3500 |
| −0.0288 | −0.0810 | 6.3500 |
| −0.0394 | −0.0905 | 6.3500 |
| −0.0503 | −0.1000 | 6.3500 |
| −0.0611 | −0.1093 | 6.3500 |
| −0.0720 | −0.1184 | 6.3500 |
| −0.0828 | −0.1273 | 6.3500 |
| −0.0938 | −0.1363 | 6.3500 |
| −0.1049 | −0.1452 | 6.3500 |
| −0.1161 | −0.1540 | 6.3500 |
| −0.1274 | −0.1627 | 6.3500 |
| −0.1387 | −0.1713 | 6.3500 |
| −0.1503 | −0.1800 | 6.3500 |
| −0.1617 | −0.1884 | 6.3500 |

TABLE 2-continued

| X | Y | Z |
|---|---|---|
| −0.1730 | −0.1967 | 6.3500 |
| −0.1846 | −0.2050 | 6.3500 |
| −0.1962 | −0.2132 | 6.3500 |
| −0.2079 | −0.2213 | 6.3500 |
| −0.2196 | −0.2294 | 6.3500 |
| −0.2313 | −0.2374 | 6.3500 |
| −0.2431 | −0.2454 | 6.3500 |
| −0.2550 | −0.2533 | 6.3500 |
| −0.2668 | −0.2611 | 6.3500 |
| −0.2787 | −0.2689 | 6.3500 |
| −0.2907 | −0.2767 | 6.3500 |
| −0.3027 | −0.2843 | 6.3500 |
| −0.3148 | −0.2921 | 6.3500 |
| −0.3268 | −0.2996 | 6.3500 |
| −0.3389 | −0.3072 | 6.3500 |
| −0.3510 | −0.3147 | 6.3500 |
| −0.3630 | −0.3220 | 6.3500 |
| −0.3752 | −0.3294 | 6.3500 |
| −0.3873 | −0.3368 | 6.3500 |
| −0.3995 | −0.3441 | 6.3500 |
| −0.4118 | −0.3513 | 6.3500 |
| −0.4241 | −0.3585 | 6.3500 |
| −0.4364 | −0.3656 | 6.3500 |
| −0.4487 | −0.3727 | 6.3500 |
| −0.4611 | −0.3798 | 6.3500 |
| −0.4734 | −0.3868 | 6.3500 |
| −0.4858 | −0.3939 | 6.3500 |
| −0.4982 | −0.4009 | 6.3500 |
| −0.5106 | −0.4078 | 6.3500 |
| −0.5131 | −0.4092 | 6.3500 |
| −0.5155 | −0.4106 | 6.3500 |
| −0.5180 | −0.4120 | 6.3500 |
| −0.5205 | −0.4134 | 6.3500 |
| −0.5230 | −0.4148 | 6.3500 |
| −0.5254 | −0.4162 | 6.3500 |
| −0.5279 | −0.4177 | 6.3500 |
| −0.5304 | −0.4190 | 6.3500 |
| −0.5329 | −0.4204 | 6.3500 |
| −0.5354 | −0.4218 | 6.3500 |
| −0.5380 | −0.4233 | 6.3500 |
| −0.5405 | −0.4250 | 6.3500 |
| −0.5429 | −0.4268 | 6.3500 |
| −0.5451 | −0.4289 | 6.3500 |
| −0.5471 | −0.4312 | 6.3500 |
| −0.5489 | −0.4336 | 6.3500 |
| −0.5503 | −0.4363 | 6.3500 |
| −0.5514 | −0.4391 | 6.3500 |
| −0.5520 | −0.4421 | 6.3500 |
| −0.5520 | −0.4451 | 6.3500 |
| −0.5516 | −0.4481 | 6.3500 |
| −0.5506 | −0.4509 | 6.3500 |
| −0.5492 | −0.4536 | 6.3500 |
| −0.5473 | −0.4560 | 6.3500 |
| −0.5452 | −0.4582 | 6.3500 |
| −0.5428 | −0.4600 | 6.3500 |
| −0.5403 | −0.4617 | 6.3500 |
| −0.5376 | −0.4631 | 6.3500 |
| SECTION 10 | | |
| −0.6215 | −0.4955 | 6.6900 |
| −0.6188 | −0.4974 | 6.6900 |
| −0.6160 | −0.4991 | 6.6900 |
| −0.6131 | −0.5007 | 6.6900 |
| −0.6100 | −0.5021 | 6.6900 |
| −0.6070 | −0.5034 | 6.6900 |
| −0.6038 | −0.5047 | 6.6900 |
| −0.6008 | −0.5058 | 6.6900 |
| −0.5978 | −0.5070 | 6.6900 |
| −0.5946 | −0.5082 | 6.6900 |
| −0.5915 | −0.5094 | 6.6900 |
| −0.5757 | −0.5144 | 6.6900 |
| −0.5595 | −0.5177 | 6.6900 |
| −0.5430 | −0.5198 | 6.6900 |
| −0.5265 | −0.5208 | 6.6900 |
| −0.5099 | −0.5208 | 6.6900 |
| −0.4933 | −0.5196 | 6.6900 |
| −0.4769 | −0.5174 | 6.6900 |
| −0.4606 | −0.5142 | 6.6900 |

TABLE 2-continued

| X | Y | Z |
|---|---|---|
| −0.4445 | −0.5101 | 6.6900 |
| −0.4286 | −0.5052 | 6.6900 |
| −0.4130 | −0.4996 | 6.6900 |
| −0.3977 | −0.4934 | 6.6900 |
| −0.3825 | −0.4866 | 6.6900 |
| −0.3676 | −0.4793 | 6.6900 |
| −0.3529 | −0.4716 | 6.6900 |
| −0.3384 | −0.4635 | 6.6900 |
| −0.3242 | −0.4550 | 6.6900 |
| −0.3101 | −0.4462 | 6.6900 |
| −0.2962 | −0.4371 | 6.6900 |
| −0.2826 | −0.4277 | 6.6900 |
| −0.2691 | −0.4180 | 6.6900 |
| −0.2558 | −0.4081 | 6.6900 |
| −0.2427 | −0.3979 | 6.6900 |
| −0.2298 | −0.3874 | 6.6900 |
| −0.2171 | −0.3767 | 6.6900 |
| −0.2046 | −0.3659 | 6.6900 |
| −0.1923 | −0.3547 | 6.6900 |
| −0.1801 | −0.3434 | 6.6900 |
| −0.1681 | −0.3320 | 6.6900 |
| −0.1563 | −0.3203 | 6.6900 |
| −0.1447 | −0.3085 | 6.6900 |
| −0.1332 | −0.2965 | 6.6900 |
| −0.1219 | −0.2844 | 6.6900 |
| −0.1107 | −0.2721 | 6.6900 |
| −0.0996 | −0.2598 | 6.6900 |
| −0.0886 | −0.2474 | 6.6900 |
| −0.0777 | −0.2348 | 6.6900 |
| −0.0669 | −0.2222 | 6.6900 |
| −0.0562 | −0.2096 | 6.6900 |
| −0.0455 | −0.1969 | 6.6900 |
| −0.0349 | −0.1841 | 6.6900 |
| −0.0244 | −0.1712 | 6.6900 |
| −0.0140 | −0.1583 | 6.6900 |
| −0.0036 | −0.1454 | 6.6900 |
| 0.0067 | −0.1324 | 6.6900 |
| 0.0169 | −0.1193 | 6.6900 |
| 0.0270 | −0.1062 | 6.6900 |
| 0.0371 | −0.0930 | 6.6900 |
| 0.0471 | −0.0797 | 6.6900 |
| 0.0571 | −0.0664 | 6.6900 |
| 0.0669 | −0.0531 | 6.6900 |
| 0.0767 | −0.0397 | 6.6900 |
| 0.0864 | −0.0262 | 6.6900 |
| 0.0960 | −0.0127 | 6.6900 |
| 0.1055 | 0.0009 | 6.6900 |
| 0.1150 | 0.0146 | 6.6900 |
| 0.1243 | 0.0283 | 6.6900 |
| 0.1335 | 0.0421 | 6.6900 |
| 0.1427 | 0.0559 | 6.6900 |
| 0.1517 | 0.0698 | 6.6900 |
| 0.1607 | 0.0838 | 6.6900 |
| 0.1695 | 0.0978 | 6.6900 |
| 0.1783 | 0.1119 | 6.6900 |
| 0.1869 | 0.1261 | 6.6900 |
| 0.1955 | 0.1403 | 6.6900 |
| 0.2039 | 0.1546 | 6.6900 |
| 0.2123 | 0.1689 | 6.6900 |
| 0.2206 | 0.1833 | 6.6900 |
| 0.2288 | 0.1977 | 6.6900 |
| 0.2369 | 0.2122 | 6.6900 |
| 0.2449 | 0.2267 | 6.6900 |
| 0.2528 | 0.2413 | 6.6900 |
| 0.2607 | 0.2559 | 6.6900 |
| 0.2684 | 0.2706 | 6.6900 |
| 0.2761 | 0.2853 | 6.6900 |
| 0.2837 | 0.3001 | 6.6900 |
| 0.2912 | 0.3149 | 6.6900 |
| 0.2987 | 0.3297 | 6.6900 |
| 0.3060 | 0.3446 | 6.6900 |
| 0.3075 | 0.3475 | 6.6900 |
| 0.3090 | 0.3505 | 6.6900 |
| 0.3104 | 0.3535 | 6.6900 |
| 0.3119 | 0.3565 | 6.6900 |
| 0.3133 | 0.3595 | 6.6900 |
| 0.3148 | 0.3625 | 6.6900 |
| 0.3162 | 0.3655 | 6.6900 |

TABLE 2-continued

| X | Y | Z |
|---|---|---|
| 0.3176 | 0.3684 | 6.6900 |
| 0.3191 | 0.3714 | 6.6900 |
| 0.3205 | 0.3744 | 6.6900 |
| 0.3211 | 0.3760 | 6.6900 |
| 0.3215 | 0.3777 | 6.6900 |
| 0.3216 | 0.3794 | 6.6900 |
| 0.3214 | 0.3811 | 6.6900 |
| 0.3210 | 0.3827 | 6.6900 |
| 0.3204 | 0.3843 | 6.6900 |
| 0.3195 | 0.3857 | 6.6900 |
| 0.3185 | 0.3870 | 6.6900 |
| 0.3172 | 0.3882 | 6.6900 |
| 0.3157 | 0.3891 | 6.6900 |
| 0.3142 | 0.3897 | 6.6900 |
| 0.3125 | 0.3901 | 6.6900 |
| 0.3108 | 0.3902 | 6.6900 |
| 0.3091 | 0.3900 | 6.6900 |
| 0.3075 | 0.3895 | 6.6900 |
| 0.3060 | 0.3888 | 6.6900 |
| 0.3046 | 0.3878 | 6.6900 |
| 0.3033 | 0.3867 | 6.6900 |
| 0.3023 | 0.3853 | 6.6900 |
| 0.3007 | 0.3827 | 6.6900 |
| 0.2991 | 0.3801 | 6.6900 |
| 0.2975 | 0.3775 | 6.6900 |
| 0.2960 | 0.3749 | 6.6900 |
| 0.2944 | 0.3723 | 6.6900 |
| 0.2928 | 0.3697 | 6.6900 |
| 0.2912 | 0.3671 | 6.6900 |
| 0.2896 | 0.3645 | 6.6900 |
| 0.2880 | 0.3619 | 6.6900 |
| 0.2864 | 0.3593 | 6.6900 |
| 0.2785 | 0.3463 | 6.6900 |
| 0.2706 | 0.3333 | 6.6900 |
| 0.2626 | 0.3203 | 6.6900 |
| 0.2547 | 0.3073 | 6.6900 |
| 0.2467 | 0.2943 | 6.6900 |
| 0.2387 | 0.2814 | 6.6900 |
| 0.2306 | 0.2684 | 6.6900 |
| 0.2225 | 0.2555 | 6.6900 |
| 0.2144 | 0.2426 | 6.6900 |
| 0.2062 | 0.2298 | 6.6900 |
| 0.1980 | 0.2170 | 6.6900 |
| 0.1896 | 0.2042 | 6.6900 |
| 0.1812 | 0.1915 | 6.6900 |
| 0.1728 | 0.1789 | 6.6900 |
| 0.1642 | 0.1663 | 6.6900 |
| 0.1555 | 0.1537 | 6.6900 |
| 0.1468 | 0.1412 | 6.6900 |
| 0.1380 | 0.1288 | 6.6900 |
| 0.1290 | 0.1165 | 6.6900 |
| 0.1200 | 0.1042 | 6.6900 |
| 0.1108 | 0.0921 | 6.6900 |
| 0.1016 | 0.0800 | 6.6900 |
| 0.0922 | 0.0680 | 6.6900 |
| 0.0827 | 0.0560 | 6.6900 |
| 0.0731 | 0.0442 | 6.6900 |
| 0.0634 | 0.0324 | 6.6900 |
| 0.0536 | 0.0208 | 6.6900 |
| 0.0437 | 0.0092 | 6.6900 |
| 0.0337 | −0.0022 | 6.6900 |
| 0.0235 | −0.0136 | 6.6900 |
| 0.0133 | −0.0249 | 6.6900 |
| 0.0029 | −0.0361 | 6.6900 |
| −0.0075 | −0.0471 | 6.6900 |
| −0.0181 | −0.0581 | 6.6900 |
| −0.0287 | −0.0690 | 6.6900 |
| −0.0395 | −0.0798 | 6.6900 |
| −0.0504 | −0.0905 | 6.6900 |
| −0.0613 | −0.1011 | 6.6900 |
| −0.0724 | −0.1115 | 6.6900 |
| −0.0835 | −0.1220 | 6.6900 |
| −0.0947 | −0.1323 | 6.6900 |
| −0.1060 | −0.1425 | 6.6900 |
| −0.1174 | −0.1526 | 6.6900 |
| −0.1291 | −0.1630 | 6.6900 |
| −0.1404 | −0.1726 | 6.6900 |
| −0.1520 | −0.1824 | 6.6900 |

TABLE 2-continued

| X | Y | Z |
|---|---|---|
| −0.1638 | −0.1921 | 6.6900 |
| −0.1756 | −0.2017 | 6.6900 |
| −0.1876 | −0.2111 | 6.6900 |
| −0.1996 | −0.2205 | 6.6900 |
| −0.2118 | −0.2296 | 6.6900 |
| −0.2240 | −0.2387 | 6.6900 |
| −0.2364 | −0.2477 | 6.6900 |
| −0.2488 | −0.2565 | 6.6900 |
| −0.2617 | −0.2655 | 6.6900 |
| −0.2738 | −0.2738 | 6.6900 |
| −0.2864 | −0.2824 | 6.6900 |
| −0.2991 | −0.2908 | 6.6900 |
| −0.3118 | −0.2992 | 6.6900 |
| −0.3246 | −0.3076 | 6.6900 |
| −0.3374 | −0.3158 | 6.6900 |
| −0.3502 | −0.3240 | 6.6900 |
| −0.3631 | −0.3321 | 6.6900 |
| −0.3761 | −0.3401 | 6.6900 |
| −0.3891 | −0.3480 | 6.6900 |
| −0.4022 | −0.3558 | 6.6900 |
| −0.4154 | −0.3634 | 6.6900 |
| −0.4287 | −0.3708 | 6.6900 |
| −0.4421 | −0.3780 | 6.6900 |
| −0.4557 | −0.3850 | 6.6900 |
| −0.4693 | −0.3917 | 6.6900 |
| −0.4832 | −0.3981 | 6.6900 |
| −0.4971 | −0.4043 | 6.6900 |
| −0.5111 | −0.4103 | 6.6900 |
| −0.5252 | −0.4161 | 6.6900 |
| −0.5393 | −0.4218 | 6.6900 |
| −0.5534 | −0.4276 | 6.6900 |
| −0.5675 | −0.4334 | 6.6900 |
| −0.5817 | −0.4388 | 6.6900 |
| −0.5846 | −0.4399 | 6.6900 |
| −0.5874 | −0.4409 | 6.6900 |
| −0.5903 | −0.4421 | 6.6900 |
| −0.5931 | −0.4432 | 6.6900 |
| −0.5959 | −0.4444 | 6.6900 |
| −0.5987 | −0.4456 | 6.6900 |
| −0.6015 | −0.4467 | 6.6900 |
| −0.6044 | −0.4478 | 6.6900 |
| −0.6073 | −0.4487 | 6.6900 |
| −0.6102 | −0.4495 | 6.6900 |
| −0.6134 | −0.4504 | 6.6900 |
| −0.6165 | −0.4515 | 6.6900 |
| −0.6195 | −0.4528 | 6.6900 |
| −0.6224 | −0.4544 | 6.6900 |
| −0.6251 | −0.4563 | 6.6900 |
| −0.6276 | −0.4585 | 6.6900 |
| −0.6298 | −0.4610 | 6.6900 |
| −0.6316 | −0.4637 | 6.6900 |
| −0.6330 | −0.4667 | 6.6900 |
| −0.6338 | −0.4699 | 6.6900 |
| −0.6340 | −0.4732 | 6.6900 |
| −0.6337 | −0.4765 | 6.6900 |
| −0.6330 | −0.4797 | 6.6900 |
| −0.6318 | −0.4828 | 6.6900 |
| −0.6303 | −0.4857 | 6.6900 |
| −0.6285 | −0.4885 | 6.6900 |
| −0.6264 | −0.4910 | 6.6900 |
| −0.6240 | −0.4933 | 6.6900 |

It should be understood that the finished first stage power turbine vane 46A does not necessarily include all the sections defined in Table 2. The portion of the airfoil 58 proximal to the platforms 64 and 65 may not be defined by a profile section 66. It should be considered that the vane 46A airfoil profile proximal to the platforms 64, 66 may vary due to several imposed constraints. However, the vane 46A has an intermediate airfoil portion defined between platforms 64, 65 thereof and which has a profile defined on the basis of at least the intermediate sections of the various vane profile sections 66 defined in Table 2.

It should be appreciated that the intermediate airfoil portion of the vane 46A is defined between the inner and outer gaspath walls 28 and 30 and that the platforms 64, 65 forms part of the gaspath walls 28, 30. The airfoil profile physically appearing on vane 46A and fully contained in the gaspath includes Sections 2 to 9 of Table 2. The remaining sections are at least partly located outside of the gaspath 27, but are provided, in part, to fully define the airfoil surface and/or, in part, to improve curve-fitting of the airfoil at its radially distal portions. The skilled reader will appreciate that a suitable fillet radius is to be applied between the platforms 64, 65 and the airfoil portion of the vane. The vane inner diameter endwall fillet is in the range of about 0.040" to about 0.095". The vane outer diameter endwall fillet ranges from about 0.040" to about 0.070. The local ID/OD endwall profile tolerance is +/−0.015".

Figure 5:
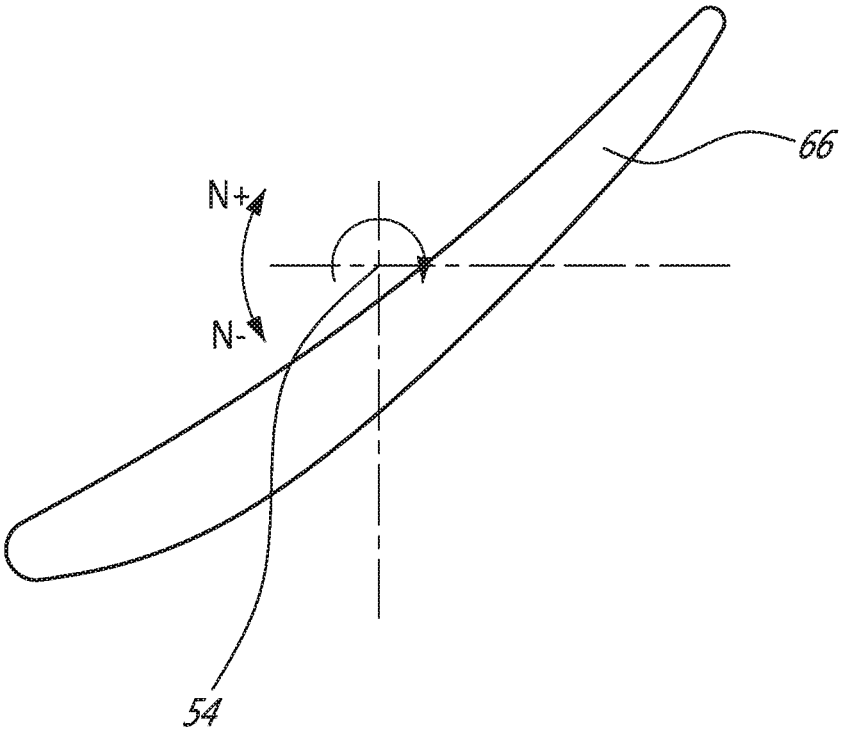
FIG. 5 is a schematic simplified 2D first stage power turbine vane airfoil cross-section illustrating the angular twist and restagger tolerances.

FIG. 5 illustrates the tolerances on twist angles. The twist "N" is an angular variation at each vane section, whereas restagger is the angular reposition of the entire airfoil. Both the twist and the restagger angles are about the stacking line 54. The section twist "N" (section restagger) tolerance with respect to the stacking line is +/−0.99 degrees (casting tolerance). The global restagger capability for the airfoil with respect to the stacking line is +/−2 degrees (throat area adjustment).

The above description is meant to be exemplary only, and one skilled in the art will recognize that changes may be made to the embodiments described without department from the scope of the invention disclosed. All modifications which fall within the scope of the present invention will be apparent to those skilled in the art, in light of a review of this disclosure, and such modifications are intended to fall within the appended claims.

The invention claimed is:

1. A turbine vane of a gas turbine engine having a gaspath, the turbine vane comprising an airfoil having an intermediate portion contained within the gaspath and defined by a nominal un-coated profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z, wherein X and Y values define a set of points for each Z value which when connected by smooth continuing arcs define an airfoil profile section, the profile sections at the Z distances being joined smoothly with one another to form an airfoil shape of the intermediate portion.

2. The turbine vane as defined in claim 1, wherein the turbine vane is a power turbine vane of the gas turbine engine.

3. The turbine vane as defined in claim 2, wherein the power turbine vane is a first stage power turbine vane of a multi-stage power turbine.

4. The turbine vane as defined in claim 1, wherein the turbine vane has a manufacturing tolerance of ±0.009 inches in a direction perpendicular to the airfoil.

5. A turbine vane for a gas turbine engine having a gaspath, the turbine vane having an intermediate airfoil portion contained within the gaspath and defined by a cold un-coated nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

6. The turbine vane as defined in claim 5, wherein the turbine vane is a power turbine vane of the gas turbine engine.

7. The turbine vane as defined in claim 6, wherein the power turbine vane is a first stage power turbine vane of a multi-stage power turbine.

8. The turbine vane as defined in claim 6, wherein the power turbine vane has a manufacturing tolerance of ±0.009 inches.

9. A turbine stator assembly for a gas turbine engine having a gaspath, the assembly comprising a plurality of vanes, each vane including an airfoil having an intermediate portion contained within the gaspath and defined by a cold un-coated nominal profile substantially in accordance with Cartesian coordinate values of X, Y, and Z of Sections 2 to 9 set forth in Table 2, wherein the point of origin of the orthogonally related axes X, Y and Z is located at an intersection of a centerline of the gas turbine engine and a stacking line of the turbine vane, the Z values are radial distances measured along the stacking line, the X and Y are coordinate values defining the profile at each distance Z.

10. A first stage power turbine vane comprising: at least one airfoil having a surface lying substantially on the points of Table 2, the airfoil extending between platforms defined generally by at least some of the coordinate values given in Table 1, wherein a fillet radius is applied around the airfoil between the airfoil and platforms.

* * * * *